US009429871B1

(12) United States Patent
His et al.

(10) Patent No.: US 9,429,871 B1
(45) Date of Patent: Aug. 30, 2016

(54) TONER SUPPLY CONTAINER AND APPLICATIONS OF SAME

(71) Applicant: GENERAL PLASTIC INDUSTRIAL CO., LTD., Taichung County (TW)

(72) Inventors: Chuang Chin His, Taichung County (TW); Xiao Zheng Yi, Taichung County (TW)

(73) Assignee: GENERAL PLASTIC INDUSTRIAL CO., LTD., Taichung County (TW)

( * ) Notice: Subject to any disclaimer, the term of this patent is extended or adjusted under 35 U.S.C. 154(b) by 0 days.

(21) Appl. No.: 14/946,878

(22) Filed: Nov. 20, 2015

(51) Int. Cl.
*G03G 15/00* (2006.01)
*G03G 15/08* (2006.01)

(52) U.S. Cl.
CPC ..... *G03G 15/0867* (2013.01)

(58) Field of Classification Search
CPC ..... G03G 15/0832; G03G 15/0867
See application file for complete search history.

(56) References Cited

U.S. PATENT DOCUMENTS

| | | | | |
|---|---|---|---|---|
| 5,446,478 | A | 8/1995 | Larson | |
| 8,565,649 | B2 | 10/2013 | Murakami et al. | |
| 2012/0014713 | A1* | 1/2012 | Murakami | G03G 15/0865 399/119 |
| 2013/0209140 | A1* | 8/2013 | Murakami | G03G 15/0875 399/258 |

* cited by examiner

*Primary Examiner* — Minh Phan
*Assistant Examiner* — Victor Verbitsky
(74) *Attorney, Agent, or Firm* — Locke Lord LLP; Tim Tingkang Xia, Esq.

(57) ABSTRACT

A releasing mechanism usable for a toner supply container includes a rotatable structure, a stationary structure engaged with the rotatable structure, and a pump movably connected to the stationary structure. The rotatable structure has a first magnetic member. The stationary structure has an opening for releasing toner and a second magnetic member. The pump has a pumping portion that is expandable. A first force drives the rotatable structure to rotate relative to the stationary structure, such that the first magnetic member is alternatively aligned and misaligned with the second magnetic member. When the first and second magnetic members are aligned, the pump is pushed away from the stationary structure by a repelling force generated between the first magnetic member and the second magnetic member. When the first and second magnetic members are misaligned, the pump is pushed by a second force toward the stationary structure.

19 Claims, 42 Drawing Sheets

110

110

135

130

130

141

145

150

150

157

158

158

161

162

162

170

170

176

177

177

178

180

180

180

180

FIG. 17C
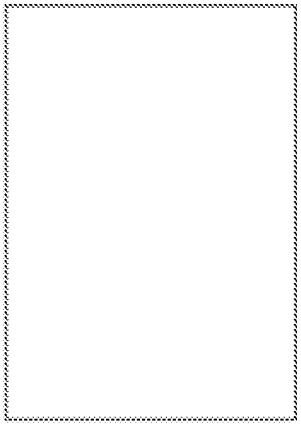
FIG. 17B
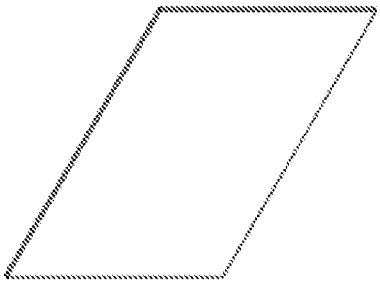
FIG. 17A
183

185

187

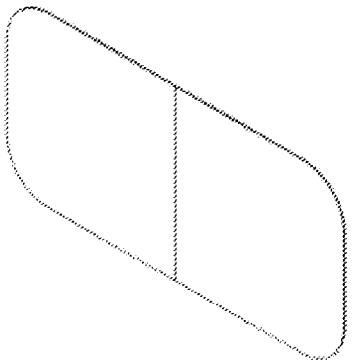
FIG. 20A
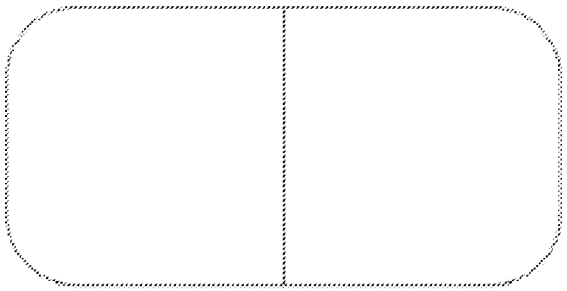
FIG. 20B
FIG. 20C
189

190

190

192

TONER SUPPLY CONTAINER AND APPLICATIONS OF SAME

FIELD OF THE INVENTION

The invention relates generally to a toner supply container, and more particularly to a toner supply container that has a pump for pushing toner, and the pump is driven by a magnetic repulsive force.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

In a conventional electrophotographic image forming apparatus such as an electrophotographic copying machine or a printer, fine particles toner is used as a developer. When the toner in the main assembly of the electrophotographic image forming apparatus is used up, the toner is supplied into the main assembly of the image forming apparatus using a toner supply container (a toner accommodating container).

Here, the electrophotographic image forming apparatus is an apparatus which forms images on a recording material through an electrophotographic image formation type process. The electrophotographic image forming apparatus includes a, an electrophotographic copying machine, an electrophotographic printer (laser beam printer, LED printer, for example), a facsimile machine, word processor or the like.

Since the toner is very fine powder, it is known to place, upon toner supplying operation, a toner supply container inside the main assembly of the image forming apparatus and to gradually supply the toner through a small opening to avoid scattering of the toner.

Any one of the above-described toner supply containers receives a driving force from the main assembly of an image forming apparatus to drive the toner supply container to discharge the toner. Various drive transmission methods are proposed for driving the toner supply container. However, the conventional structures involve some problems.

Therefore, a heretofore unaddressed need exists in the art to address the aforementioned deficiencies and inadequacies.

SUMMARY OF THE INVENTION

In one aspect, the invention relates to a toner supply container for supply toner to an apparatus. In one embodiment, the toner supply container includes a container body and a releasing mechanism.

The container body has a first end and an opposite, second end defining an inner space therebetween for accommodating the toner. The releasing mechanism includes a gear, a first magnetic member, a releasing member, a second magnetic member, a pump, an elastic member, and a housing. The gear has a first end and an opposite, second end that is fixed to the first end of the container body. The first magnetic member is fixed to the gear. The releasing member has a first end and an opposite, second end, an opening in fluid communication with the inner space of the container body, and a sliding sheet slidable to cover or to expose the opening. The first end of the gear is rotatably fixed to the second end of the releasing member. The second magnetic member is fixed to the pump. The pump is movably connected to the first end of the releasing member. The elastic member urges against the pump. The housing accommodates a part of the gear, the first magnetic member, the releasing member, the second magnetic member, the pump, and the elastic member.

When a driving force from the apparatus drives the gear to rotate, the rotation of the gear causes the first magnetic member to rotate so that the first magnetic member is alternatively aligned and misaligned with the second magnetic member.

When the first magnetic member and the second magnetic member are aligned at an aligned position, the pump is pushed away from the releasing member by a repelling force generated between the first magnetic member and the second magnetic member. When the first magnetic member and the second magnetic member are misaligned at a misaligned position, the pump is pushed toward the releasing member by the elastic member.

Alternatively, when the first magnetic member and the second magnetic member are aligned at an aligned position, the pump is pulled toward the releasing member by an attracting force generated between the first magnetic member and the second magnetic member. When the first magnetic member and the second magnetic member are misaligned at a misaligned position, the pump is pulled away from the releasing member by the elastic member.

In one embodiment, when the first magnetic member rotates from the aligned position to the misaligned position relative to the second magnetic member, the pump pushes the toner located at the releasing member out to the apparatus through the opening.

In one embodiment, when the first magnetic member rotates from the misaligned position to the aligned position relative to the second magnetic member, the toner located at the container body is moved to the releasing member.

In one embodiment, when the toner supply container is detachably mounted to the apparatus, the sliding sheet is fixed to the apparatus, and the sliding sheet slides to expose the opening.

In one embodiment, the toner supply container further includes a first fixing member for fixing the second magnetic member and a second fixing member for fixing the elastic member. The pump has a first end in a plate shape, the first fixing member is disposed at one side of the first end of the pump, the second fixing member is disposed at the other side of the first end, and a protrusion hook of the second fixing member passes through a through hole of the pump and a through hole of the first fixing member, and fixes the first fixing member, the pump and the second fixing member together.

In one embodiment, the pump further has a second end opposite to the first end, the second end is fixed to the releasing member, such that the first fixing member, the pump and the second fixing member are fixed to the releasing member.

In one embodiment, the second fixing member further has a protrusion tube projected away from the pump, and engaging with a protrusion from the housing. The elastic member sleeves on the protrusion tube of the second fixing member and the protrusion of the housing. One end of the elastic member urges the second fixing member, and the other end of the elastic member urges the housing.

In one embodiment, the pump has a first end away from the releasing member and an opposite, second end facing the releasing member and fixed to the releasing member, and a plurality of pumping portions located at the first end, the pumping portions are movable relative to the releasing member.

In one embodiment, the container body, the gear, the releasing member, and the pump are in fluid communication.

In one embodiment, the first magnetic member has two pairs of magnetic bars that are symmetrically disposed relative to a longitudinal axis of the container body.

In one embodiment, the second magnetic member comprises two magnetic bars that are symmetrically disposed relative to a longitudinal axis of the container body.

In another aspect, the present invention relates to a releasing mechanism usable for a toner supply container. The releasing mechanism includes a rotatable structure, a stationary structure, and a pump. The rotatable structure has a first magnetic member. The stationary structure is engaged with the rotatable member. The stationary structure has an opening for releasing toner. The pump is movably connected to the stationary structure, and has at least one pumping portion that is expandable. A second magnetic member is connected to the at least one pumping portion.

When driving by a first force, the rotatable structure rotates relative to the stationary structure, such that the first magnetic member is alternatively aligned and misaligned with the second magnetic member.

When the first magnetic member and the second magnetic member are aligned, the pump is pushed away from the stationary structure by a repelling force generated between the first magnetic member and the second magnetic member. When the first magnetic member and the second magnetic member are misaligned, the pump is pushed by a second force toward the stationary structure.

Alternatively, when the first magnetic member and the second magnetic member are aligned, the pump is pulled toward the stationary structure by an attracting force generated between the first magnetic member and the second magnetic member. When the first magnetic member and the second magnetic member are misaligned, the pump is pulled away from the stationary structure by the second force.

In one embodiment, when the first magnetic member and the second magnetic member are misaligned, the pump is pushed by the second force toward the stationary structure, and the toner is pushed out from the opening of the stationary structure.

In one embodiment, the releasing mechanism further includes a housing configured to accommodate a part of the rotatable structure, the first magnetic member, the stationary structure, the second magnetic member, and the pump. The housing is fixed to the stationary structure, and the rotatable structure is rotatable relative to the housing.

In one embodiment, the second force is provided by an elastic member. One end of the elastic member urges the pump, and the other end of the elastic member urges the housing.

In one embodiment, an inner space of the container body, an inner space of the rotatable structure, and an inner space of the stationary structure are in fluid communication.

In one embodiment, the releasing mechanism further includes a sliding sheet slidably attached to the stationary structure. When the releasing mechanism is attached to an apparatus, the sliding sheet slides relative to the stationary structure to expose the opening, and the sliding sheet is fixed to the apparatus to positioning the stationary structure to the apparatus.

In one embodiment, the first magnetic member has two pairs of magnetic bars that are symmetrically disposed relative to an longitudinal axis of the rotatable structure.

In one embodiment, the second magnetic member has two magnetic bars that are symmetrically disposed relative to an longitudinal axis of the stationary structure.

In a further aspect, the present invention relates to an apparatus for electrophotographic image forming. The apparatus has a toner supply container having the releasing mechanism as described above.

These and other aspects of the present invention will become apparent from the following description of the embodiment taken in conjunction with the following drawings, although variations and modifications therein may be affected without departing from the spirit and scope of the novel concepts of the present invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

FIGS. 17A-17C schematically show three-dimensional, front, and side views of a chip label of the toner supply container according to one embodiment of the present invention.

FIGS. 20A-20C schematically show three-dimensional, front, and side views of a housing label of the toner supply container according to one embodiment of the present invention.

FIG. 23A is a three dimensional sectional view with the toner supply container cut in half from top to bottom, FIG. 23B is a partial enlarged view of FIG. 23A, FIG. 23C is a three dimensional sectional view with the toner supply container cut in half from left to right, and FIG. 23D is a partial enlarged view of FIG. 23C.

FIG. 24A is a three dimensional sectional view with the toner supply container cut in half from top to bottom, FIG. 24B is a partial enlarged view of FIG. 24A, FIG. 24C is a three dimensional sectional view with the toner supply container cut in half from left to right, and FIG. 24D is a partial enlarged view of FIG. 24C.

DETAILED DESCRIPTION OF THE INVENTION

Figure 1:
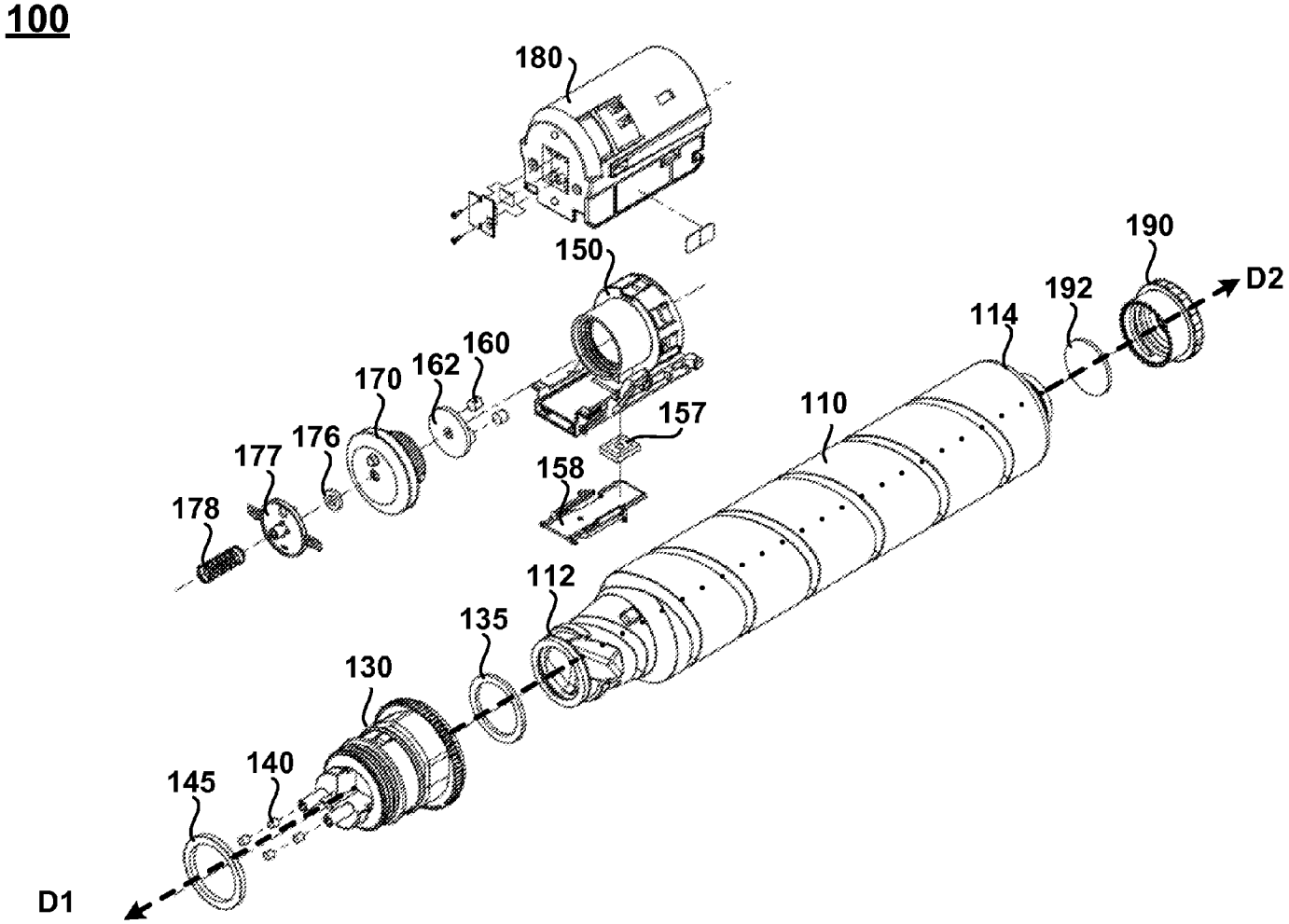
FIG. 1 schematically shows a three-dimensional view of a toner supply container according to one embodiment of the invention.
Figure 2A:
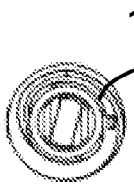
FIGS. 2A-2F schematically show front, back, left, right, top, and bottom views of a container body of the toner supply container according to one embodiment of the present invention, and FIGS. 2G-2J schematically show three-dimensional views of the container body from different angles.
Figure 2B:
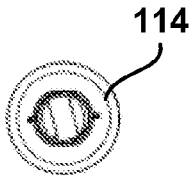
Figure 2C:
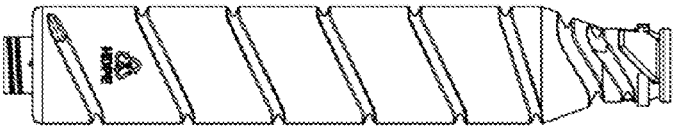
Figure 2D:
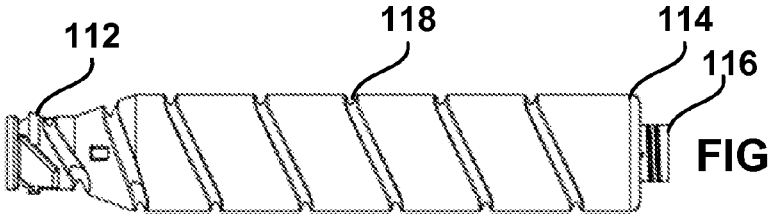
Figure 2E:
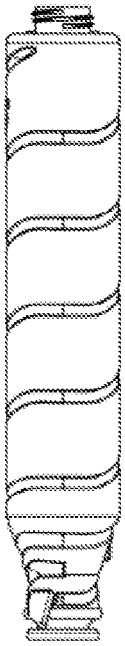
Figure 2F:
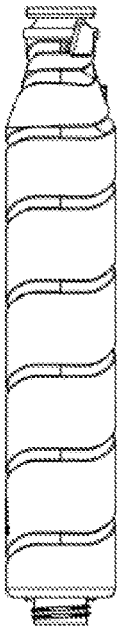
Figure 2H:
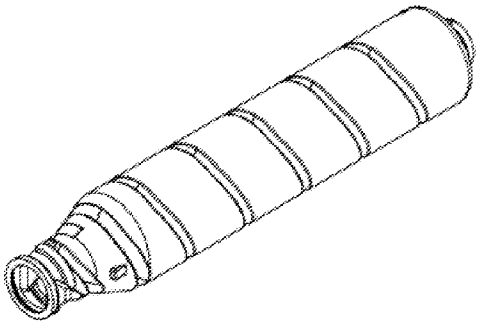
Figure 2J:
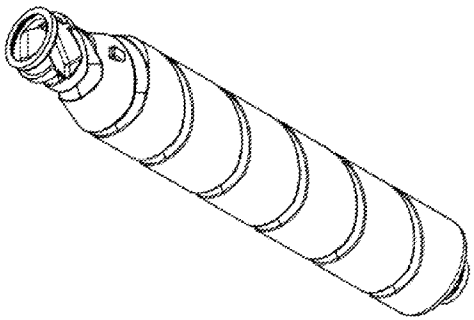
Figure 2G:
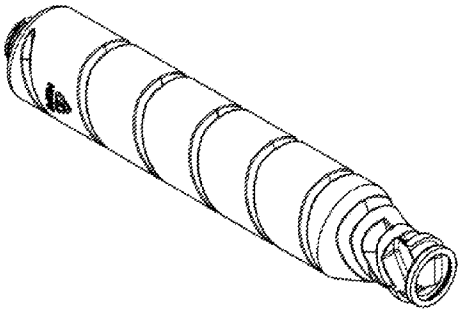
Figure 2I:
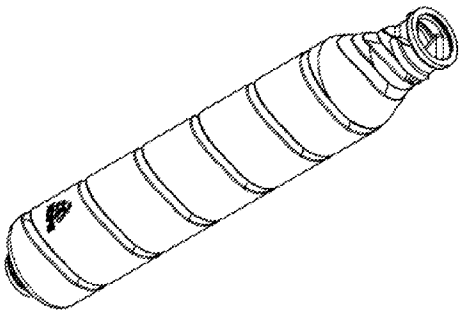

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

As used in the description herein and throughout the claims that follow, the meaning of "a", "an", and "the" includes plural reference unless the context clearly dictates otherwise. It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about", "substantially" or "approximately" shall generally mean within 20 percent, preferably within 10 percent, and more preferably within 5 percent of a given value or range. Numerical quantities given herein are approximate, meaning that the terms "around", "about", "substantially" or "approximately" can be inferred if not expressly stated.

As used herein, "plurality" means two or more.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the invention.

Further, relative terms, such as "lower" or "bottom" and "upper" or "top", may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The description will be made as to the embodiments of the invention in conjunction with the accompanying drawings. In accordance with the purposes of this invention, as embodied and broadly described herein, this invention, in one aspect, relates to a toner supply container.

FIG. 1 schematically shows a three-dimensional exploded view of a toner supply container 100 according to one embodiment of the invention. Referring to FIG. 1, the toner supply container 100 includes a container body 110, a gear 130, a first magnetic member 140, a releasing member 150, a sliding sheet 158, a second magnetic member 160, a pump 170, an elastic member 178, a housing 180, and a cap 190.

As shown in FIGS. 1 and 2A-2J, the container body 110 is basically in a shape of a cylinder, and has a first end 112, and a second end 114 opposite to the first end 112. In certain embodiments, the shape of the container body 110 may not be cylindrical as long as it can accommodate the toner and is rotatable relative to the housing 180. The container body 110 has a rotational axis along the longitudinal direction, and an radial direction located at the circular sectional plane of the cylinder. A direction D1 is defined as the direction from the second end 114 toward the first end 112 along the rotational axis, and a direction D2 is defined as the direction from the first end 112 toward the second end 114 along the rotational axis. In certain embodiments, the D1 direction is also named front direction, and the D2 direction is also named back direction. The container body 110 defines an inner space between the first end 112 and the second end 114 for accommodating toner. In one embodiment, an outer surface of the container body 110 is concavely formed with a screw shaped groove 118 along the container body 110. In other words, an inner surface of the container body 110 is protruded inward to form the structure 118. When the container body 110 is rotated, the screw shaped groove 118 is configured to move the toner inside the container body 110 along the D1 direction. In one embodiment, the container body 110 further has a capping portion 116 extending from the second end 114 toward the D2 direction. A diameter of the capping portion 116 is smaller than a diameter of the main body portion of the container body 110. A free end of the capping portion 116 is threaded at the outer surface, the cap 190 is threaded at the inner surface, such that the cap 190 is fixable to the capping portion 116 by screwing. In this embodiment, the cap 190 is screwed to the capping portion 116. In other embodiments, the cap 190 may be fixable to the capping portion 116 by other means, for example, press fitting.

Figure 4A:
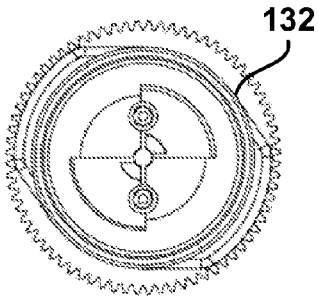
FIGS. 4A-4F schematically show front, back, left, right, top, and bottom views of a gear of the toner supply container according to one embodiment of the present invention, and FIGS. 4G-4J schematically show three-dimensional views of the gear from different angles.
Figure 4B:
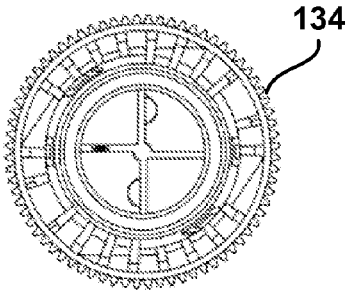
Figure 4C:
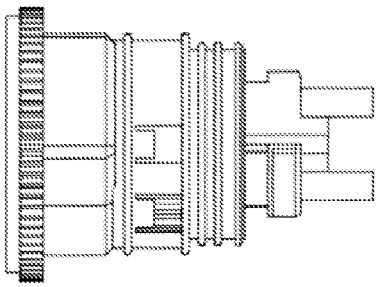
Figure 4D:
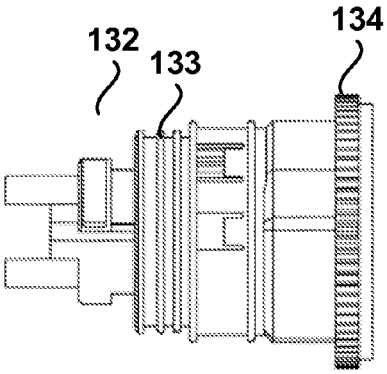
Figure 4E:
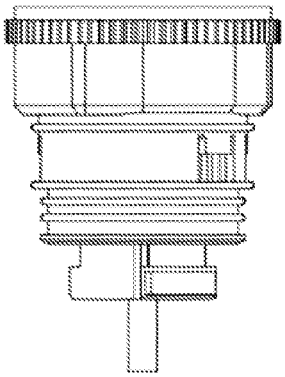
Figure 4F:
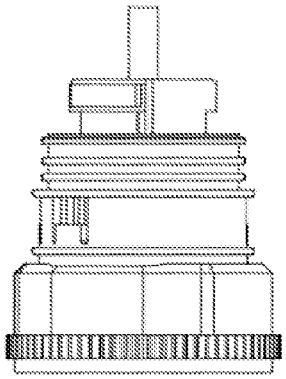
Figure 4G:
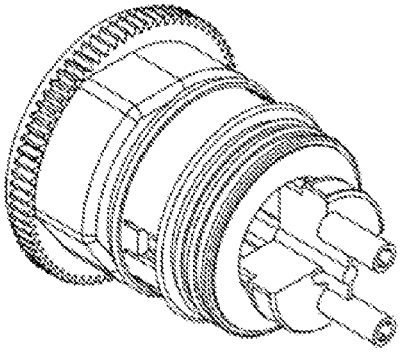
Figure 4H:
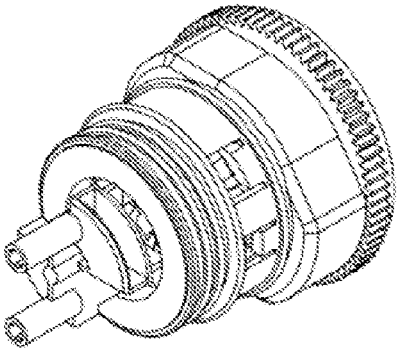
Figure 4I:
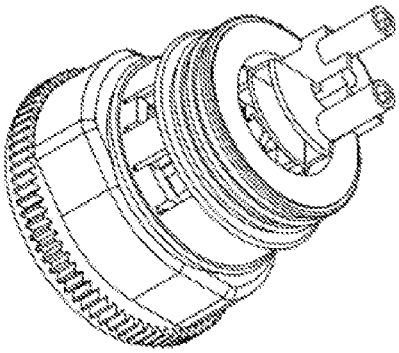
Figure 4J:
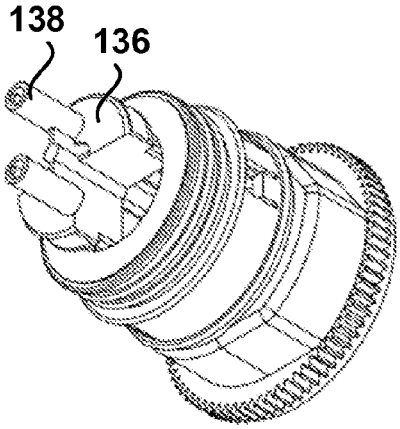

FIGS. 4A-4F schematically show front, back, left, right, top, and bottom views of a gear 130 of the toner supply container 100 according to one embodiment of the present invention, and FIGS. 4G-4J schematically show three-dimensional views of the gear 130 from different angles. As shown in FIGS. 4A-4J, the gear 130 has a first end 132 and a second end 134 opposite to the first end 132. The diameter of the second end 134 is greater than the diameter of the first end 132. The second end 134 of the gear 130 is fixed to the first end 112 of the container body 110. As shown in FIG. 23B, the first end 112 of the container body 110 is inserted into the second end 134 of the gear 130, and engages with inner side (the side facing the D2 direction) of the second end 134 of the gear 130. The gear 130 is configured to receive a driving force from the apparatus to rotate. Since the container body 110 is fixed to the gear 130, the container body 110 thus can also be rotated together with the gear 130. The first end 132 of the gear 130 has at least one ring shaped structure 133 disposed at the outside surface, so as to be rotatably engaged with the releasing member 150. In other words, when the toner supply container 100 is mounted to the apparatus, the releasing member 150 and the housing 180 are stationary relative to the apparatus, and the gear 130, together with the container body 110, are rotatable relative to the releasing member 150 and the housing 180. As shown in FIG. 4J, the gear 130 further includes at least one base portion 136 inside the first end 132, and at least one pillar 138 protruded from the base portion 136 along the D1 direction. The pillar 138 is hollow and has one opening at its free end facing the D1 direction, and is configured to receive at least one of the magnetic bar 141 of the first magnetic member 140 to be inserted therein. The first end 112 of the container body 110 is configured to be inserted into the inside tubular space of the gear 130, and engaged with the inner surface of the gear 130, that is, engaged with the back surface of the base 136 facing the D2 direction. In certain embodiments, an outside surface of the second end 134 of the gear 130 has teeth that are configured to be engaged with a gear of the apparatus (not shown), and is drivable by the gear of the apparatus. When being driven by the apparatus, the gear 130 rotates, and the container body 110 which is fixed to the gear 130, rotates as well with the gear 130.

Figure 3C:
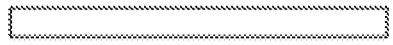
FIGS. 3A-3C schematically show three-dimensional, front, and side views of a first foam of the toner supply container according to one embodiment of the present invention.
Figure 3B:
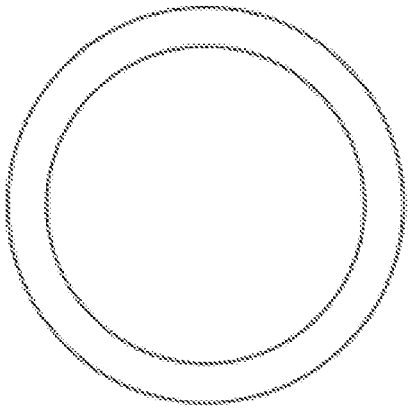
Figure 3A:
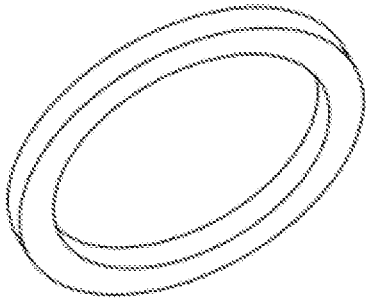

In certain embodiments, as shown in FIGS. 3A-3C, a first foam 135 is disposed between the first end 112 of the container body 110 and the second end 134 of the gear 130 to avoid leaking of the toner. In one embodiment, the first foam 135 has a shape of a ring. When the first end 112 of the container body 110 is inserted into the inside of the gear 130, the first foam 135 is located between the first end 112 of the container body 110 and the back surface of the base 136 of the gear 130. In one embodiment, the first foam 135 is made of cotton. The first end 112 of the container body 110 and the second end 134 of the gear 130 are in fluid communication with each other passing through the first foam 135.

Figure 5C:
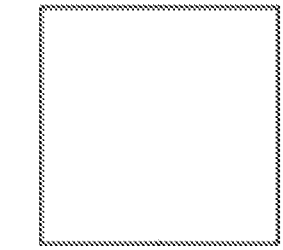
FIGS. 5A-5C schematically show three-dimensional, front, and side views of a magnetic bar of a first magnetic member of the toner supply container according to one embodiment of the present invention.
Figure 5B:
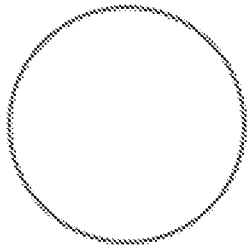
Figure 5A:
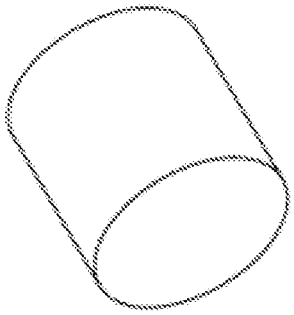
Figure 6C:
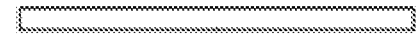
FIGS. 6A-6C schematically show three-dimensional, front, and side views of a second foam of the toner supply container according to one embodiment of the present invention.
Figure 6B:
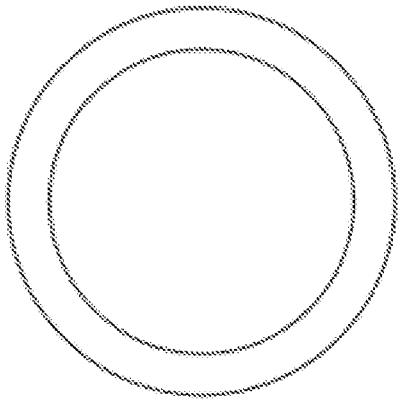
Figure 6A:
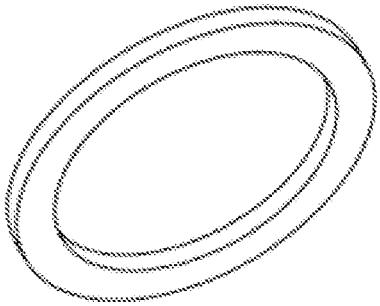
Figure 7A:
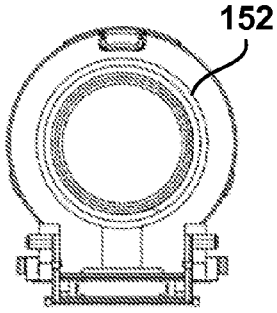
FIGS. 7A-7F schematically show front, back, left, right, top, and bottom views of a releasing member of the toner supply container according to one embodiment of the present invention, and FIGS. 7G-7J schematically show three-dimensional views of the releasing member from different angles.
Figure 7B:
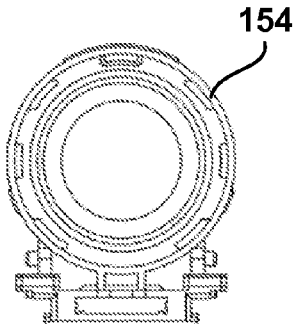
Figure 7C:
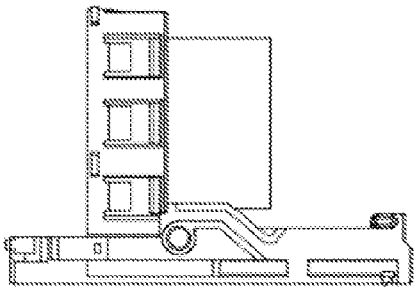
Figure 7D:
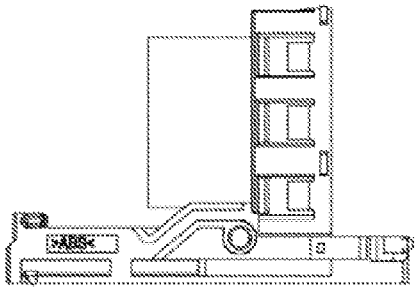
Figure 7E:
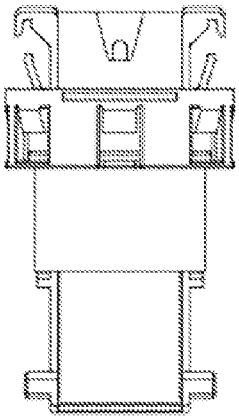
Figure 7F:
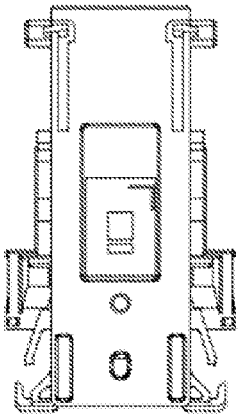
Figure 7G:
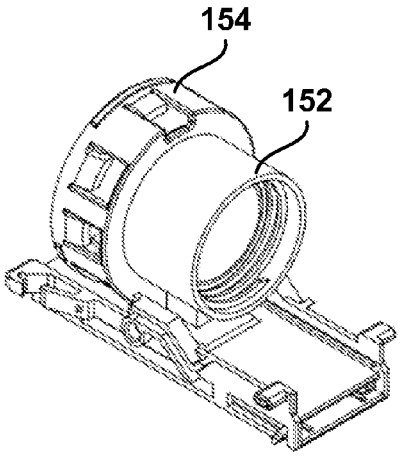
Figure 7H:
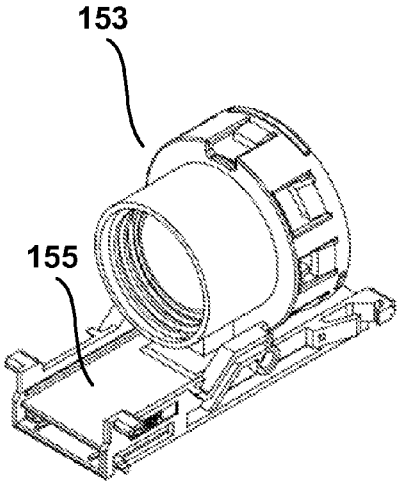
Figure 7I:
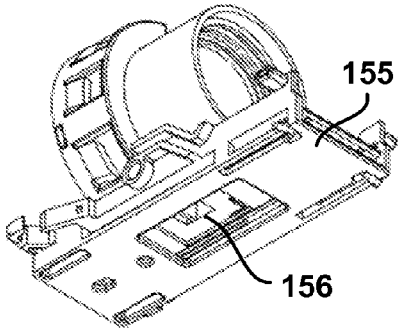
Figure 7J:
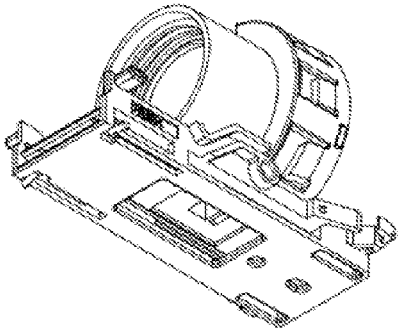
Figure 8A:
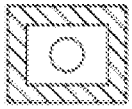
FIGS. 8A-8C schematically show top, bottom, and side views of a third foam of the toner supply container according to one embodiment of the present invention, and FIGS. 8D-8G schematically show three-dimensional views of the third foam from different angles.
Figure 8B:
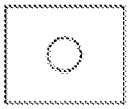
Figure 8C:
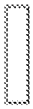
Figure 8D:
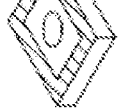
Figure 8E:
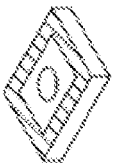
Figure 8F:
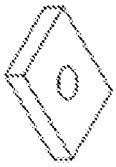
Figure 8G:
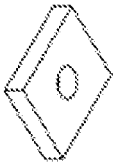
Figure 9A:
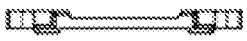
FIGS. 9A-9F schematically show front, back, left, right, top, and bottom views of a sliding sheet of the toner supply container according to one embodiment of the present invention, and FIGS. 9G-9J schematically show three-dimensional views of the sliding sheet from different angles.
Figure 9B:
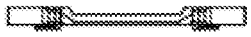
Figure 9C:
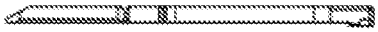
Figure 9D:
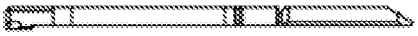
Figure 9E:
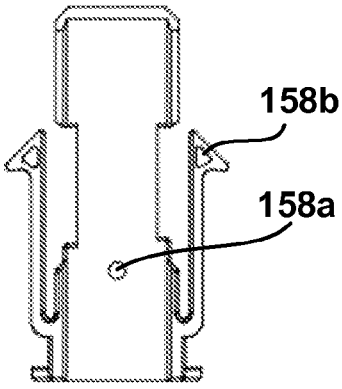
Figure 9F:
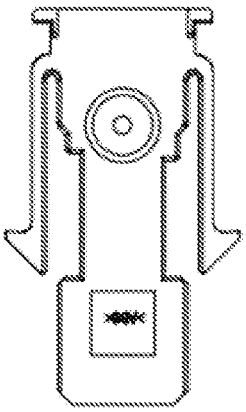
Figure 9G:
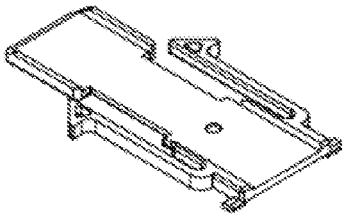
Figure 9H:
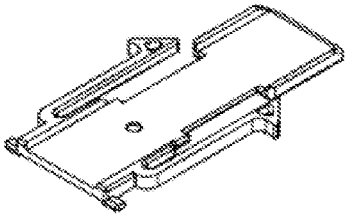
Figure 9I:
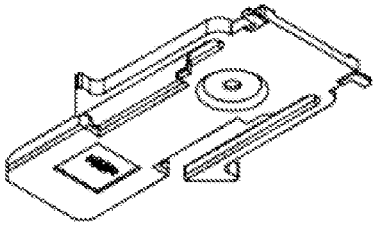
Figure 9J:
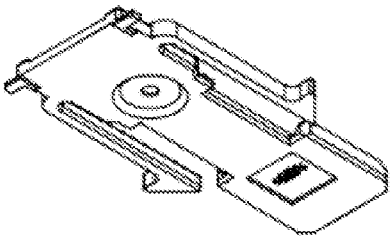

FIGS. 5A-5C schematically show three-dimensional, front, and side views of a magnetic bar 141 of the first magnetic member 140 of the toner supply container 100 according to one embodiment of the present invention. The first magnetic member 140 has at least one solid cylindrical shaped magnetic bar 141, and each magnetic bar 141 is configured to be received in the hollow pillar 138. In certain embodiments, the number of the pillar 138 is two, and the number of the magnetic bar 141 of the first magnetic member 140 is four, such that two of the magnetic bars 141 are received in each of the two pillars 138. The two magnetic bars 141 received in the same pillar 138 are aligned along the longitudinal direction, that is, along the D1/D2 direction, and are symmetrical relative to the rotational axis of the container body 110. When the gear 130 is rotated, the first magnetic member 140 rotates with the gear 130. The two pillars 138 are disposed symmetrically at two sides of the base 136, such that the four magnetic bars 141 of the first magnetic member 140 are symmetrically disposed relative to the rotational axis of the toner supply container 100.

In certain embodiments, a second foam 145 is disposed between the gear 130 and the releasing member 150 to avoid leaking of the toner. In certain embodiments, the second foam 145 is in a shape of a ring, and has a size that is larger than a size of the first foam 135. The second foam 145 is basically located between the base 136 and the front surface (facing the D1 direction) of the first end 132 of the gear 130. When the first end 132 of the gear 130 is inserted into the inside of the releasing member 150, the second foam 145 also urges a structure of the releasing member 150 that is around the opening 156, as shown in FIG. 23B. In one embodiment, the second foam 145 is made of cotton.

FIGS. 7A-7F schematically show front, back, left, right, top, and bottom views of the releasing member 150 of the toner supply container 100 according to one embodiment of the present invention, and FIGS. 7G-7J schematically show three-dimensional views of the releasing member 150 from different angles. As shown in FIGS. 7A-7J, the releasing member 150 has a tubular portion 153 and a plate portion 155 disposed below the tubular portion 153. The tubular portion 153 has a first end 152 and a second end 154. The first end 152 has a smaller diameter, and the second end 154 has a larger diameter. An opening 156 is formed through the bottom wall of the tubular portion 153 and the plate portion 155. The opening 156 is configured to release toner from the toner supply container 100 toward the apparatus.

A bottom of the plate portion 155, at the position around the opening 156, is concavely formed with an accommodating space. In one embodiment, the accommodating space is formed in a rectangular shape. When viewed from top or bottom, the opening 156 is located at the center of the rectangular accommodating space. In certain embodiments, a third foam 157 is disposed between the plate portion 155 and the sliding sheet 158, received in the accommodating space, and corresponds to the opening 156, so as to avoid leaking of the toner. As shown in FIGS. 8A-8G, the third foam 157 is in a rectangular shape, and has a through hole located at the center of the rectangular shaped foam. An upper surface of the third foam 157 is attached with glue shown with shaded lines. The glue is used to attach the third foam 157 onto the bottom surface of the plate portion 155 of the releasing member 150, at the location corresponding to the opening 156. When the toner is supplied from the toner supply container 100 to the apparatus through the opening 156, the third foam 157 can avoid leaking of the toner between the plate portion 155 and the sliding sheet 158.

The sliding sheet 158 is disposed below the plate portion 155, and is slidable relative to the plate portion 155. The sliding sheet 158 has a through hole 158*a* corresponding to the opening 156. Before the toner supply container 100 is mounted to the apparatus, the sliding sheet 158 is located below the plate portion 155 and blocks the opening 156, so that the toner will not leak from the opening 156. When the toner supply container 100 is mounted to the apparatus, the sliding sheet 158 slides relative to the plate portion 155, and the through hole 158*a* on the sliding sheet 158 is configured to be aligned with the opening 156, such that the toner can pass through the opening 156 and the through hole 158*a* to the apparatus for being used by the apparatus. The sliding sheet 158 further includes at least one hook portion 158*b* that is configured to be fixed to the apparatus, such that the toner supply container 100 is not easily retreat from the apparatus by itself during use. In one embodiment, the number of the hook portion 158*b* is two.

The first end 132 of the gear 130 is configured to be inserted inside the tubular space of the releasing member 150, and is rotatably fixed to the releasing member 150. In other words, the releasing member 150 is fixed to the housing 180 (or the apparatus), the housing 180 is fixable to the apparatus, such that the releasing member 150 and the housing 180 are stationary relative to the apparatus, while the gear 130 is rotatable relative to the toner releasing member 150, the housing 180 and the apparatus. In certain embodiments, when being inserted to the toner releasing member 150, part of the gear 130 such as the first end 132 of the gear 130 is limited by releasing member 150, such that the gear 130 will not be loosed or separated from the releasing member 150. In certain embodiments, for example, the releasing member 150 has a ring shaped groove formed in the inner side surface, and the protruded ring 133 at the outside surface of the first end 132 of the gear 130 is inserted into the ring shaped groove of the releasing member 150. In this way, the gear 130 and the releasing member 150 are engaged with each other and prevented from separated from each other, and the gear 130 is rotatable in relative to the releasing member 150.

As shown in FIG. 1, the pump 170 is fixable to the first end 152 of the releasing member 150. A first fixing member 162 is disposed between the pump 170 and the releasing member 150, and the second magnetic member 160 is received in the first fixing member 162.

Figure 10A:
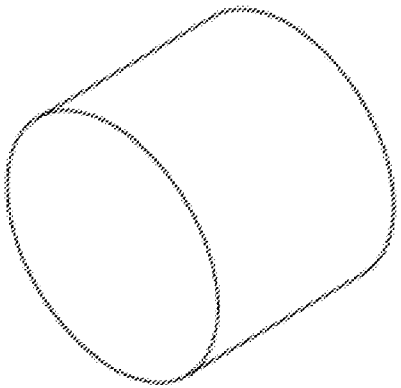
FIGS. 10A-10C schematically show three-dimensional, front, and side views of a magnetic bar of a second magnetic member of the toner supply container according to one embodiment of the present invention.
Figure 10B:
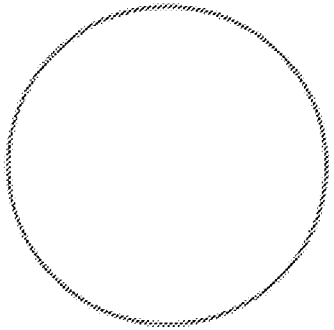
Figure 10C:
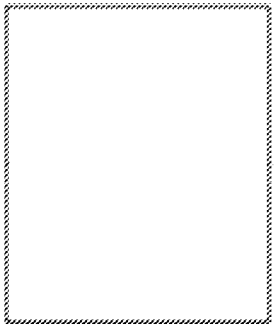

FIGS. 10A-10C schematically show three-dimensional, front, and side views of a magnetic bar 161 of the second magnetic member 160 of the toner supply container 100 according to one embodiment of the present invention. The magnetic bar 161 of the second magnetic member 160 is in a solid cylindrical shape, and is configured to be received in the first fixing member 162. The structure of the magnetic bar 161 of the second magnetic member 160 is similar to the structure of the magnetic bar 141 of the first magnetic member 140. In certain embodiments, the size of the second magnetic bar 161 is greater than the size of the first magnetic bar 141. In one embodiment, the number of the second magnetic bar 161 is two. In certain embodiments, the number and the shape of the first magnetic bar 141 and the second magnetic bar 161 are not limited to the embodiments described as above, as long as the first magnetic member 140 is able to interact with the second magnetic member 160.

Figure 11A:
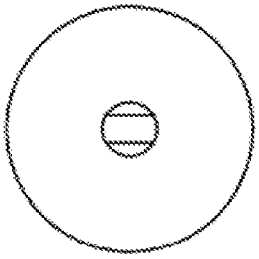
FIGS. 11A-11F schematically show front, back, left, right, top, and bottom views of a first fixing member for fixing the second magnetic member according to one embodiment of the present invention, and FIGS. 11G-11J schematically show three-dimensional views of the fixing member from different angles.
Figure 11B:
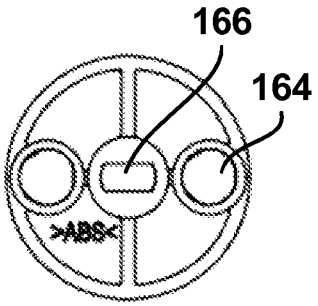
Figure 11C:
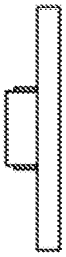
Figure 11D:
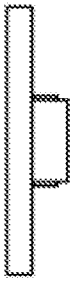
Figure 11E:
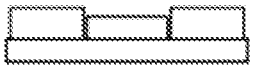
Figure 11F:
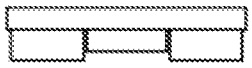
Figure 11G:
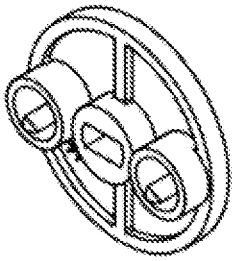
Figure 11H:
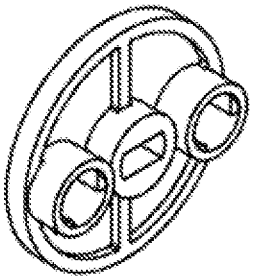
Figure 11I:
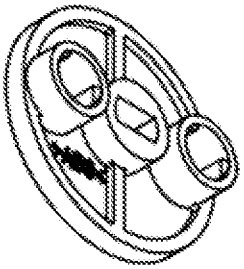
Figure 11J:
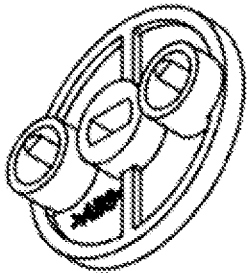
Figure 12A:
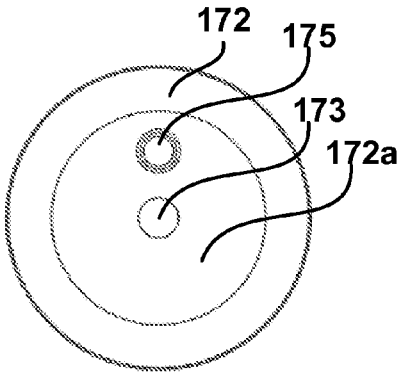
FIGS. 12A-12F schematically show front, back, left, right, top, and bottom views of a pump of the toner supply container according to one embodiment of the present invention, and FIGS. 12G-12J schematically show three-dimensional views of the pump from different angles.
Figure 12B:
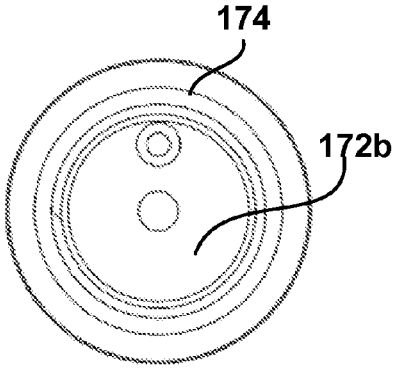
Figure 12C:
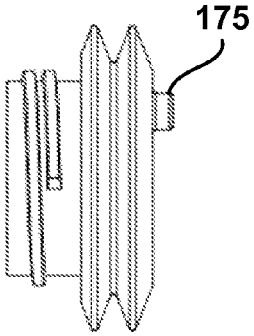
Figure 12D:
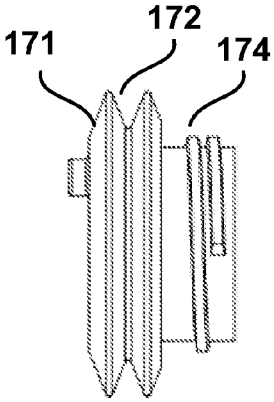
Figure 12E:
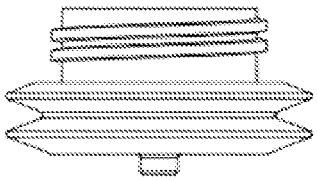
Figure 12F:
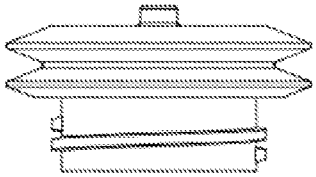
Figure 12G:
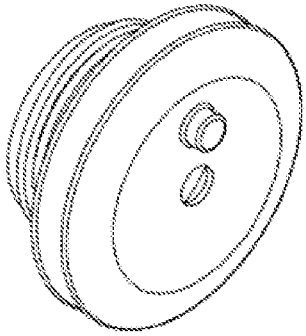
Figure 12H:
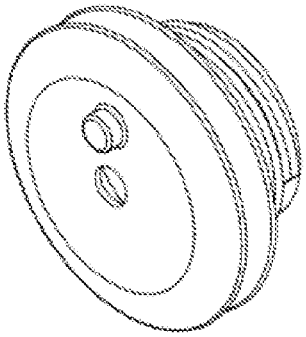
Figure 12I:
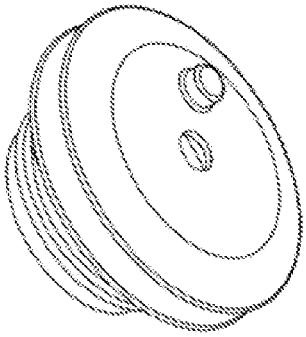
Figure 12J:
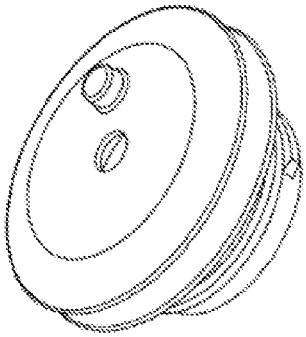

FIGS. 11A-11F schematically show front, back, left, right, top, and bottom views of the first fixing member 162 for fixing the second magnetic member 160 according to one embodiment of the present invention, and FIGS. 11G-11J schematically show three-dimensional views of the first fixing member 162 from different angles. As shown in FIG. 11B, the first fixing member 162 includes two hollow pillars 164. Each of the hollow pillars 164 is configured to receive corresponding one magnetic bar 161 of the second magnetic member 160. In certain embodiments, the two hollow pillars 164 are disposed symmetrically at two sides of the first fixing member 162. The first fixing member 162 further has a through hole 166 formed along the longitudinal direction and through the center of the first fixing member 162.

FIGS. 12A-12F schematically show front, back, left, right, top, and bottom views of the pump 170 of the toner supply container 100 according to one embodiment of the present invention, and FIGS. 12G-12J schematically show three-dimensional views of the pump 170 from different angles. The pump 170 has a first end 172 away from the releasing member 150 (front end that faces the D1 direction) and an opposite, second end 174 facing the releasing member 150 (back end that faces the D2 direction). The first end 172 has an outer surface 172*a* facing the D1 direction and an inner surface 172 *b* facing the D2 direction. The first end 172 includes two or more pumping portions 171, each of the pumping portion 171 is in a ring shaped structure, and is expandable. In certain embodiments, the pump 170 is a pneumatic pump. The second end 174 has a screw shaped protrusion around the outside surface, configured to be fixed to the inside surface of the first end 152 of the releasing member 150. When being assembled, the first fixing member 162, together with the second magnetic member 160, is attached to the inner surface 172*b* of the pump 170. The pump 170 further has a through hole 173 formed along the longitudinal direction and through the center of the pump 170. A positioning protrusion 175 protrudes from the outer surface 172*a* of the first end 172. The positioning protrusion 175 is configured to be engaged with the second fixing member 177 for positioning the second fixing member 177 relative to the pump 170.

Figure 13A:
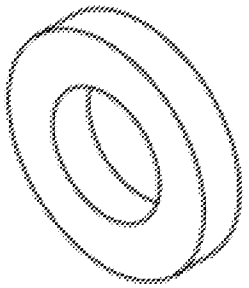
FIGS. 13A-13C schematically show three-dimensional, front, and side views of a fourth foam of the toner supply container according to one embodiment of the present invention.
Figure 13B:
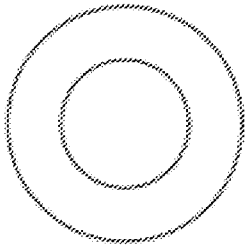
Figure 13C:
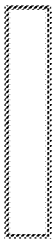
Figure 14A:
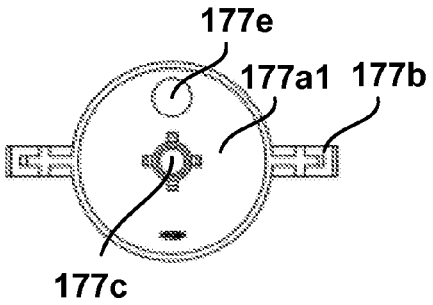
FIGS. 14A-14F schematically show front, back, left, right, top, and bottom views of a second fixing member for fixing an elastic member according to one embodiment of the present invention, and FIGS. 14G-14J schematically show three-dimensional views of the second fixing member from different angles.
Figure 14B:
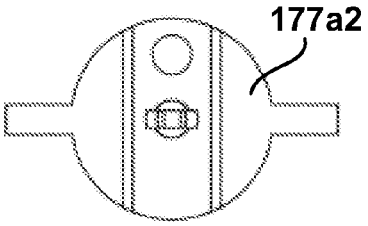
Figure 14C:
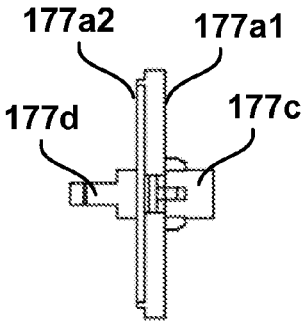
Figure 14D:
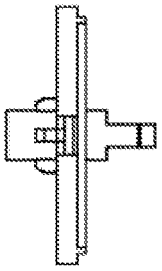
Figure 14E:
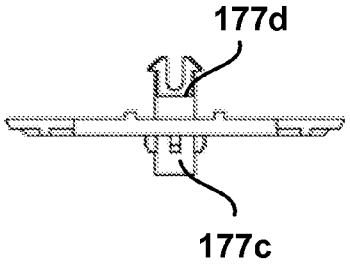
Figure 14F:
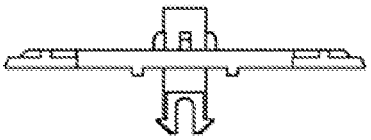
Figure 14G:
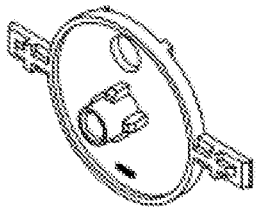
Figure 14H:
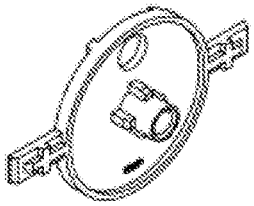
Figure 14I:
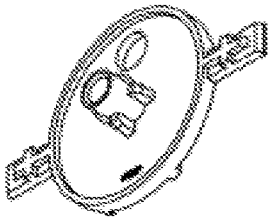
Figure 14J:
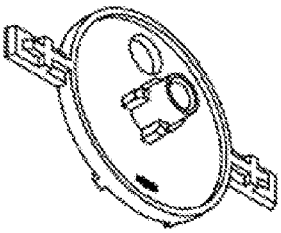

FIGS. 13A-13C schematically show three-dimensional, front, and side views of a fourth foam 176 of the toner supply container 100 according to one embodiment of the present invention. The fourth foam 176 is disposed between the pump 170 and the second fixing member 177. The fourth foam 176 is in a shape of a ring, and has a size that is much smaller than the size of the first foam 135 or the second foam 145.

FIGS. 14A-14F schematically show front, back, left, right, top, and bottom views of a second fixing member 177 for fixing the elastic member 178 according to one embodiment of the present invention, and FIGS. 14G-14J schematically show three-dimensional views of the second fixing member 177 from different angles. The second fixing member 177 has a circular plate portion 177*a*. The circular plate portion 177*a* has a front surface 177*a*1 facing the D1 direction, and a back surface 177*a*2 facing the D2 direction. Two flanging portions 177*b* extend respectively from left and right sides of the circular plate portion 177*a*. A protrusion tube 177*c* projected from the center of the circular plate portion 177*a* from the front surface 177*a*1, and a protrusion hook 177*d* projected from the center of the back surface 177*a*2. The second fixing member 177 further has a top hole 177*e* formed at the top portion of the circular plate portion 177*a* and configured to receive the positioning protrusion 175 of the pump 170. The elastic member 178 is configured to be sleeved on the protrusion tube 177*c*. At the front side of the second fixing member 177, a protrusion from the housing 180 is configured to be inserted into the protrusion tube 177*c*; at the back side of the second fixing member 177, the second fixing member 177 urges the pump 170, the positioning protrusion 175 of the pump 170 is received in the top hole 177*e* of the second fixing member 177, and the protrusion hook 177*d* passes through the fourth foam 176 and the through hole 173 of the pump 170 and hooks the pump 170, such that the second fixing member 177 is fixed between the housing 180 and the pump 170.

Figure 15C:
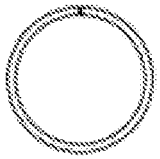
FIGS. 15A-15C schematically show three-dimensional, front, and side views of the elastic member of the toner supply container according to one embodiment of the present invention.
Figure 15B:
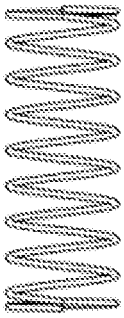
Figure 15A:
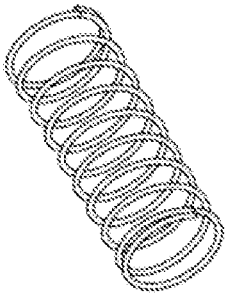
Figure 16B:
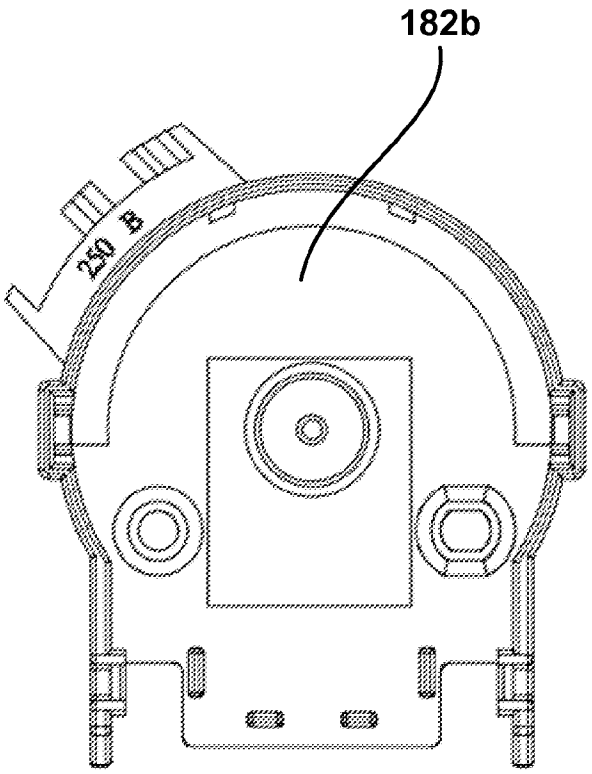
FIGS. 16A-16F schematically show front, back, left, right, top, and bottom views of a housing of the toner supply container according to one embodiment of the present invention, and FIGS. 16G-16J schematically show three-dimensional views of the housing from different angles.
Figure 16A:
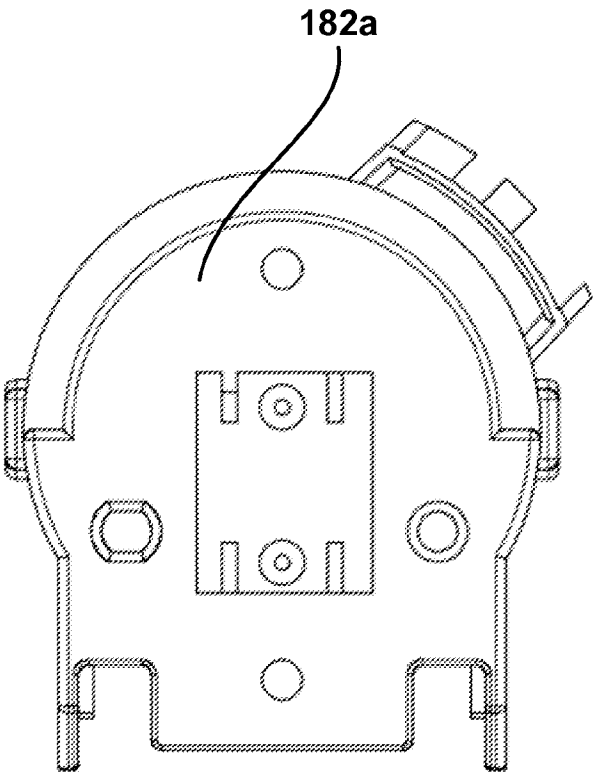
Figure 16D:
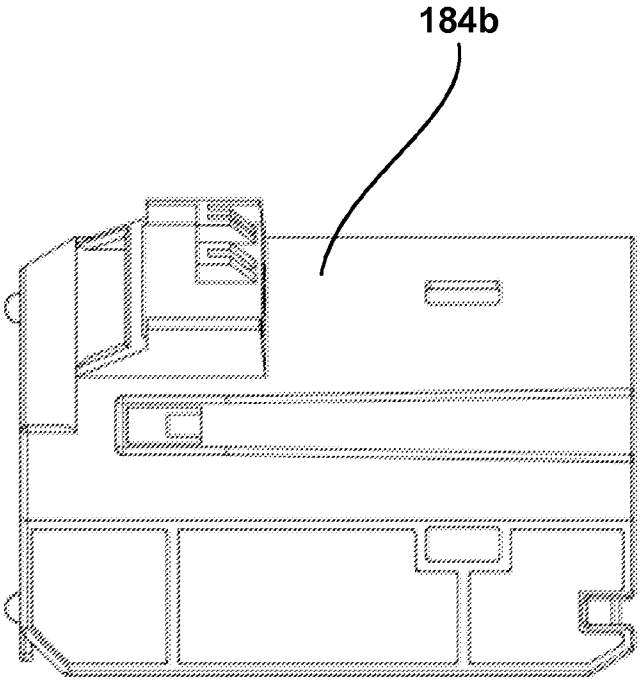
Figure 16C:
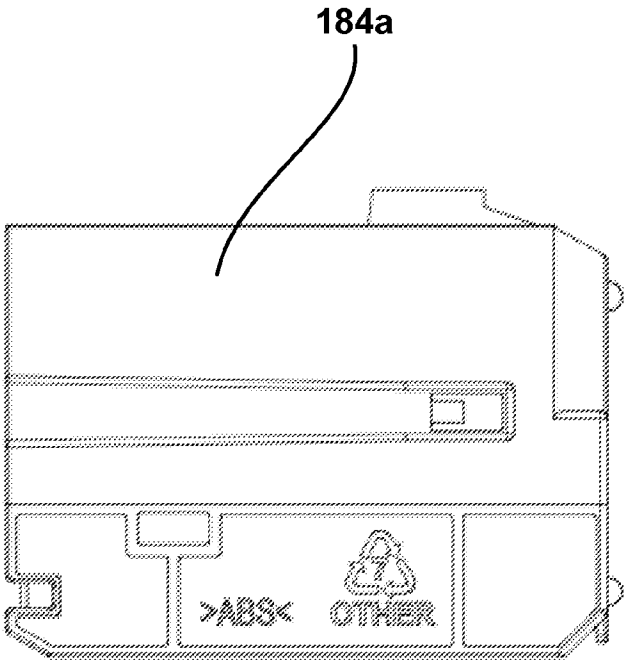
Figure 16F:
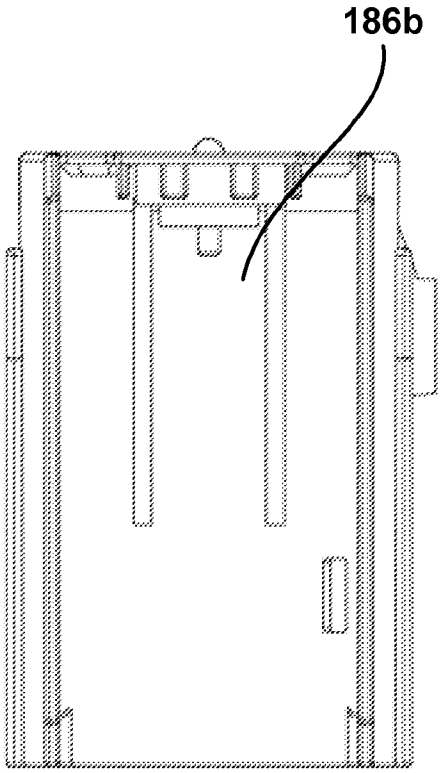
Figure 16E:
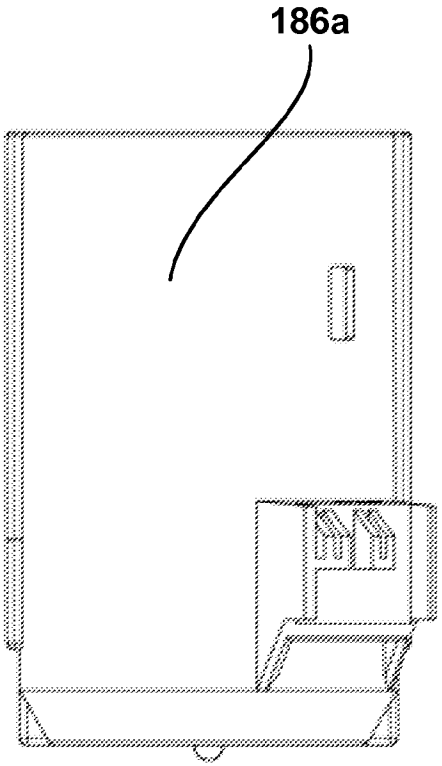
Figure 16H:
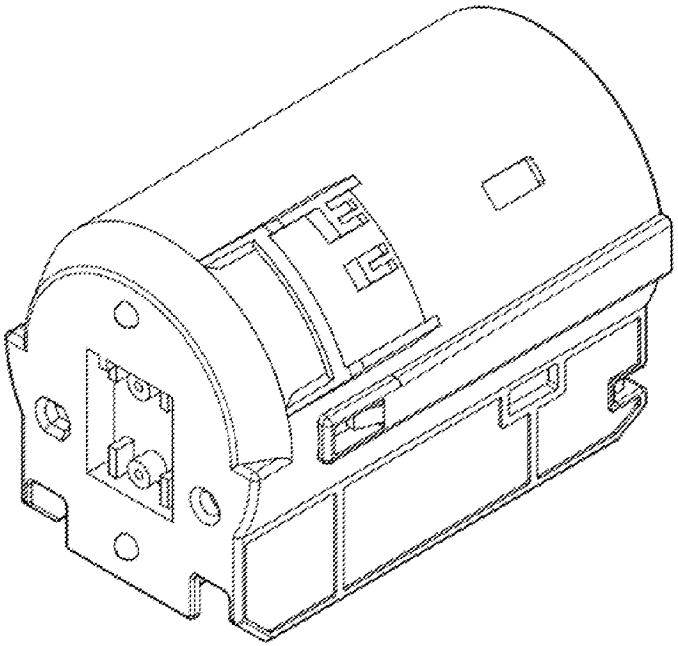
Figure 16G:
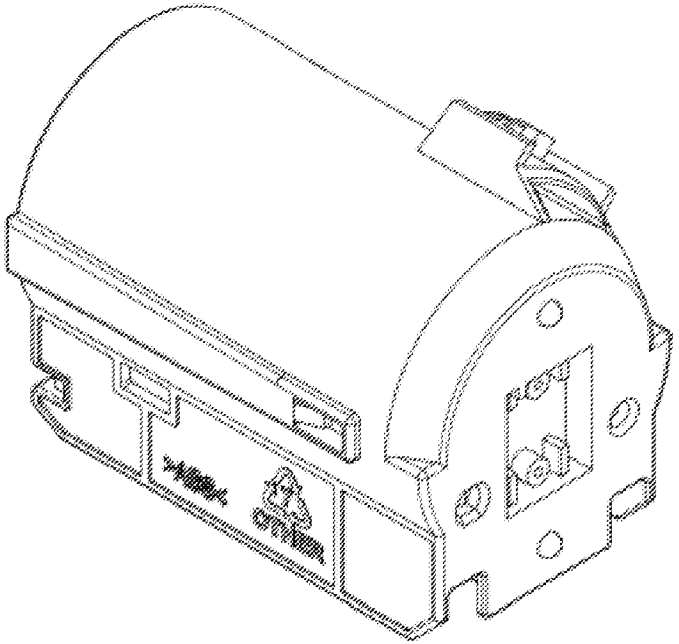
Figure 16J:
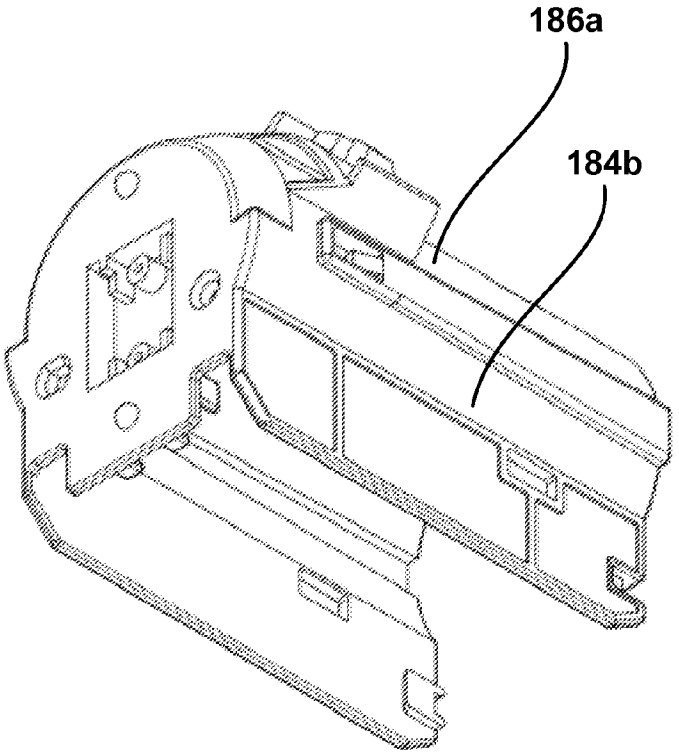
Figure 16I:
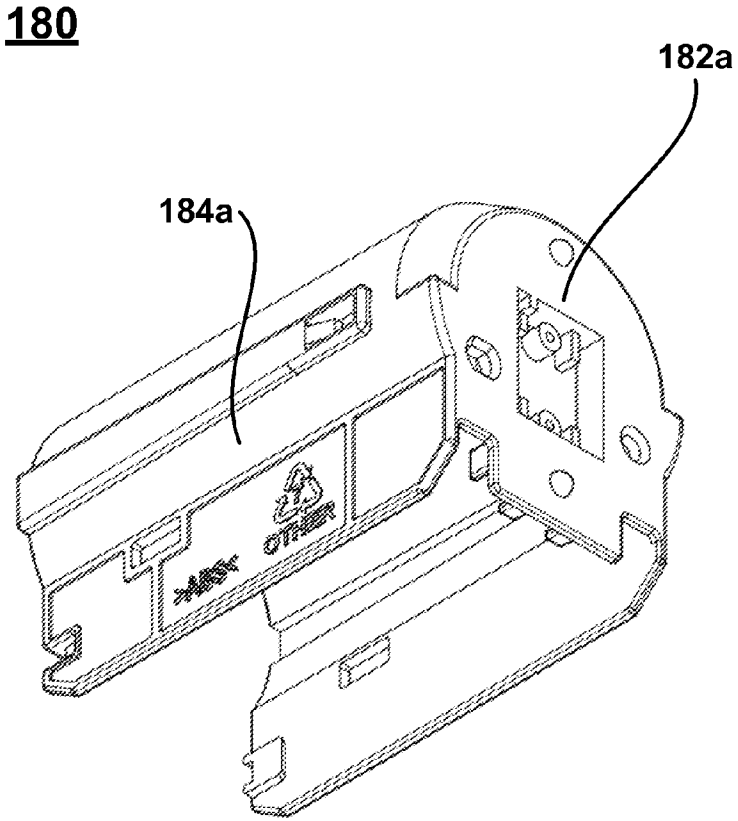
Figure 18A:
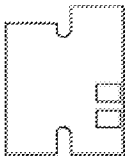
FIGS. 18A-18F schematically show front, back, left, right, top, and bottom views of a chip of the toner supply container according to one embodiment of the present invention, and FIGS. 18G-18J schematically show three-dimensional views of the chip from different angles.
Figure 18B:
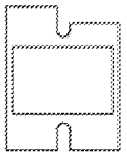
Figure 18C:
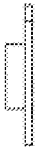
Figure 18D:
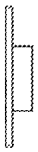
Figure 18E:
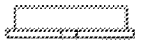
Figure 18F:
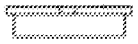
Figure 18G:
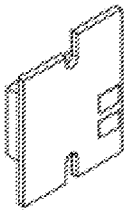
Figure 18H:
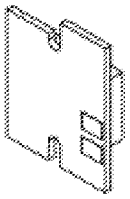
Figure 18I:
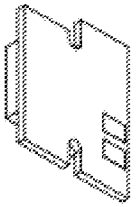
Figure 18J:
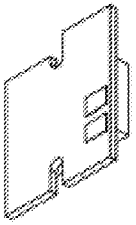
Figure 19A:
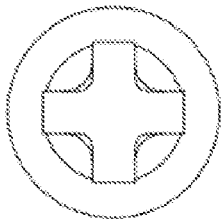
FIGS. 19A-19F schematically show front, side, and four three-dimensional views of a screw according to one embodiment of the present invention.
Figure 19B:
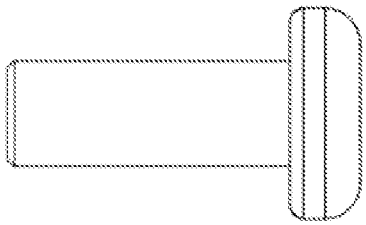
Figure 19C:
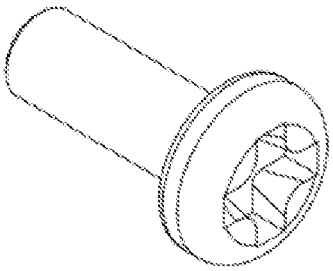
Figure 19D:
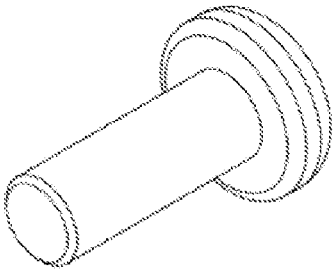
Figure 19E:
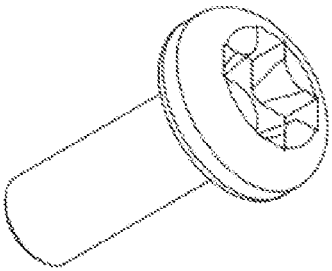
Figure 19F:
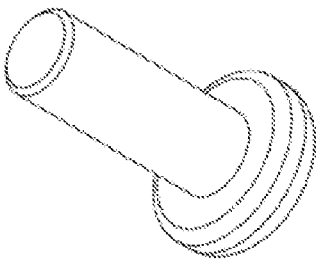
Figure 21A:
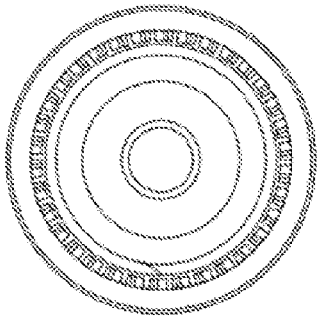
FIGS. 21A-21F schematically show front, back, left, right, top, and bottom views of a cap of the toner supply container according to one embodiment of the present invention, and FIGS. 21G-21J schematically show three-dimensional views of the cap from different angles.
Figure 21B:
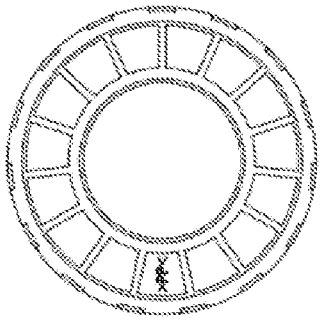
Figure 21C:
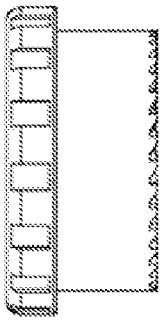
Figure 21D:
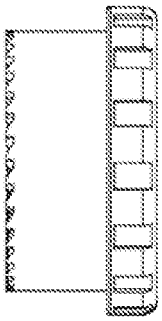
Figure 21E:
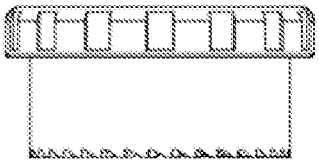
Figure 21F:
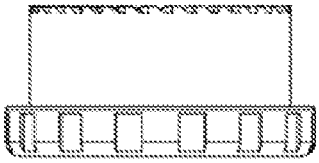
Figure 21G:
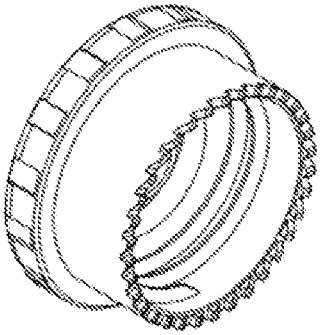
Figure 21H:
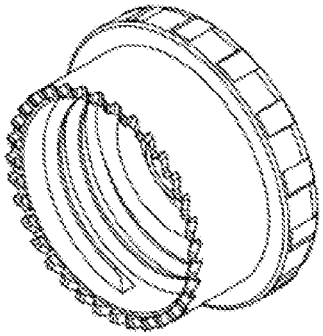
Figure 21I:
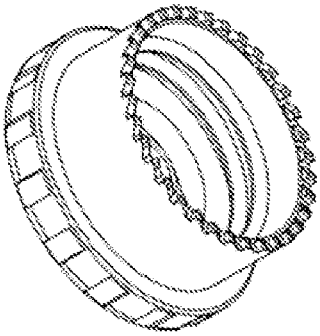
Figure 21J:
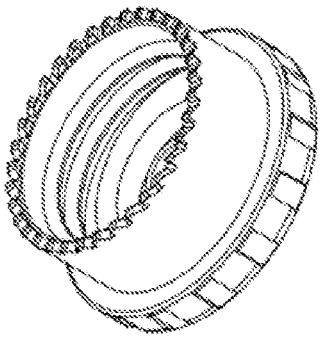

FIGS. 15A-15C schematically show three-dimensional, front, and side views of the elastic member 178 of the toner supply container 100 according to one embodiment of the present invention. In certain embodiments, the elastic member 178 may be a spring. As described above, during assembly, the elastic member 178 is sleeved on the protrusion tube 177*c* of the second fixing member 177. Thus, one end of the elastic member 178 urges the inside surface of the housing 180, and the other side of the elastic member 178 urges the front surface 177*a*1 of the second fixing member 177, such that the elastic member 178 is confined between the inside surface of the housing 180 and the second fixing member 177.

FIGS. 16A-16F schematically show front, back, left, right, top, and bottom views of a housing 180 of the toner supply container 100 according to one embodiment of the present invention, and FIGS. 16G-16J schematically show three-dimensional views of the housing 180 from different angles. The housing 180 has a first side 182*a* (front side facing the D1 direction), a second side 182*b* (back side facing the D2 direction), a third side 184*a* (left side), a fourth side 184*b* (right side), a fifth side 186*a* (top side), and a sixth side 186*b* (bottom side). The first side 182*a* is away from the container body 110, and the elastic member 178 urges the inner surface of the first side 182*a*.

In this embodiment, the second side 182*b* does not exist and are actually an open space defined by one end of the third side 184*a*, the fourth side 184*b*, and the fifth side 186*a*. The opening of the second side 182 *b* is configured to receive the elastic member 178, the second fixing member 177, the fourth foam 176, the pump 170, the first fixing member 162, the second magnetic member 160, the releasing member 150, the second foam 145, the first magnetic member 140, and part of the gear 130. The outer surface of the gear 130 is rotatably fixed to the inner surface of the housing 180.

In this embodiment, the sixth side 186*b* does not exist and are actually an opening space defined by one end of the first side 182*a*, the third side 184*a*, and the fourth side 184*b*. After the housing 180 receives the elastic member 178, the second fixing member 177, the fourth foam 176, the pump 170, the first fixing member 162, the second magnetic member 160, the releasing member 150, the second foam 145, the first magnetic member 140, and part of the gear 130, the sixth side 186*b* has the structure of the plate portion 155 of the releasing member 150, and the sliding sheet 158.

FIGS. 18A-18F schematically show front, back, left, right, top, and bottom views of a chip 185 of the toner supply container 100 according to one embodiment of the present invention, and FIGS. 18G-18J schematically show three-dimensional views of the chip 185 from different angles. The chip 185 may be used to store information of the toner supply container 100, and the stored information is retrievable by a chip reader of the apparatus or other reading device, which may aid in how to operate the toner supply container 100.

FIGS. 17A-17C schematically show three-dimensional, front, and side views of a chip label 183 of the toner supply container 100 according to one embodiment of the present invention. FIGS. 19A-19F schematically show front, side, and four three-dimensional views of a screw 187 according to one embodiment of the present invention. The number of the screw may be two or more. In certain embodiments, the chip label 183 is attached to a surface of the chip 185 to show model number or other information related to the chip 185. The chip 185 may be fixed to the outer surface of the first side 182*a* of the housing 180 by the screw 187. In other embodiments, the chip 185 may be fixed to the housing by gluing, soldering or any other appropriate method.

FIGS. 20A-20C schematically show three-dimensional, front, and side views of a housing label 189 of the toner supply container 100 according to one embodiment of the present invention. The housing label 189 may be attached to the fourth side 184*b* of the housing 180, and include information of the housing 180, or the toner supply container 100.

Figure 22C:
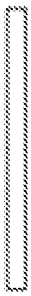
FIGS. 22A-22C schematically show three-dimensional, front, and side views of a fifth foam of the toner supply container according to one embodiment of the present invention.
Figure 22B:
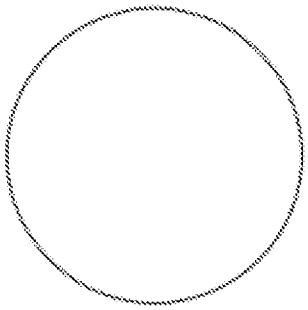
Figure 22A:
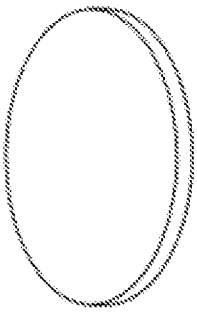

FIGS. 21A-21F schematically show front, back, left, right, top, and bottom views of a cap 190 of the toner supply container 100 according to one embodiment of the present invention, and FIGS. 21G-21J schematically show three-dimensional views of the cap 190 from different angles. The cap 190 is configured to seal the second end 114 of the toner supply container 100. In certain embodiment, as shown in FIGS. 22A-22C, a fifth foam 192 is provided between the second end 114 and the cap 190, so as to avoid leaking of the toner.

In certain embodiments, the first foam 135, the second foam 145, and the fourth foam 176 has the shape of ring. The sectional view of the ring may be a rectangular. The size of the second foam 145 is large, so that it can be sleeved on the gear 130 and seals between the gear 130 and the releasing member 150. The first foam 135 is smaller than the second foam 145. The first foam 135 is inserted in the gear 130 and seals the interface between the gear 130 and the first end surface at the first end 112 of the container 110. The fourth foam 176 is much smaller than the first foam 135 and the second foam 145. The fourth foam 176 seals the interface between the pump 170 and the second fixing member 177.

The components as shown in FIG. 1 are assembled to form the toner supply container 100. As shown in FIG. 23B and FIG. 24B, the first end 112 of the container body 110 is inserted into the second end 134 of the gear 130, and the first end 112 urges the gear 130 through the first foam 135. The first end 132 of the gear 130 is rotatably sleeved into the second end 154 of the releasing member 150. The base portion 136 and the pillar 138 of the gear 130 and the first magnetic member 140 received in the pillar 138 are disposed within the releasing member 150 toward the D1 direction, such that the first magnetic member 140 is located within the pump 170.

The pump 170 is fixed to the first end 152 of the releasing member 150. The second end 174 of the pump 170 is located within the first end 152 of the releasing member 150, and outer surface of the second end 174 of the pump 170 is fixed to the inner surface of the first end 152 of the releasing member 150. The first end 172 of the pump 170 is located outside the first end 152 of the releasing member 150.

The first fixing member 162 is located within the pump 170. The front side of the first fixing member 162 urges the back surface of the first end 172 of the pump 170, the back side of the first fixing member 162 faces the pillar 138. The second magnetic member 160 is fixed to the first fixing member 162.

The second fixing member 177 is located next to the pump 170. By the elastic force provided by the elastic member 178, the second fixing member 177 urges the front surface of the pump 170. The second fixing member 177 has the top hole 177*e* to receive the positioning protrusion 175 of the pump 170. The protrusion hook 177*d* of the second fixing member 177 passes through the fourth foam 176, the through hole 173 of the pump 170, the through hole 166 of the first fixing member 162, and hooks on the back surface of the first fixing member 162, such that the first fixing member 162 is fixed to the second fixing member 177 with the front side of the pump 170 disposed between the first fixing member 162 and the second fixing member 177.

The second fixing member 177 is located next to the pump 170. By the elastic force provided by the elastic member 178, the second fixing member 177 urges the front surface of the pump 170. The second fixing member 177 has the top hole 177*e* to receive the positioning protrusion 175 of the pump 170. The protrusion hook 177*d* of the second fixing member 177 passes through the fourth foam 176, the central hole of the pump 170, the central hole of the first fixing member 162, and hooks on the back surface of the first fixing member 162, such that the first fixing member 162 is fixed to the second fixing member 177 with the front side of the pump 170 disposed between the first fixing member 162 and the second fixing member 177.

The elastic member 178 is sleeved on the protrusion tube 177*c* of the second fixing member 177, and located between the inner surface of the housing 180 and the front surface of the second fixing member 177.

The housing 180 is fixable to the apparatus by engagement of a fixing structure disposed on the housing 180 and a corresponding fixing structure disposed on the apparatus. When the toner supply container 100 is mounted to the apparatus, the housing 180, together with the elastic member 178, the second fixing member 177, the pump 170, the first fixing member 162, the second magnetic member 160, the releasing member 150, are fixed to the apparatus. At the same time, by rotatable fixing of the gear 130 to the releasing member 150, the gear 130, together with the first magnetic member 140 and the container body 110, are rotatable relative to the housing 180, or relative to the apparatus.

Figure 23A:
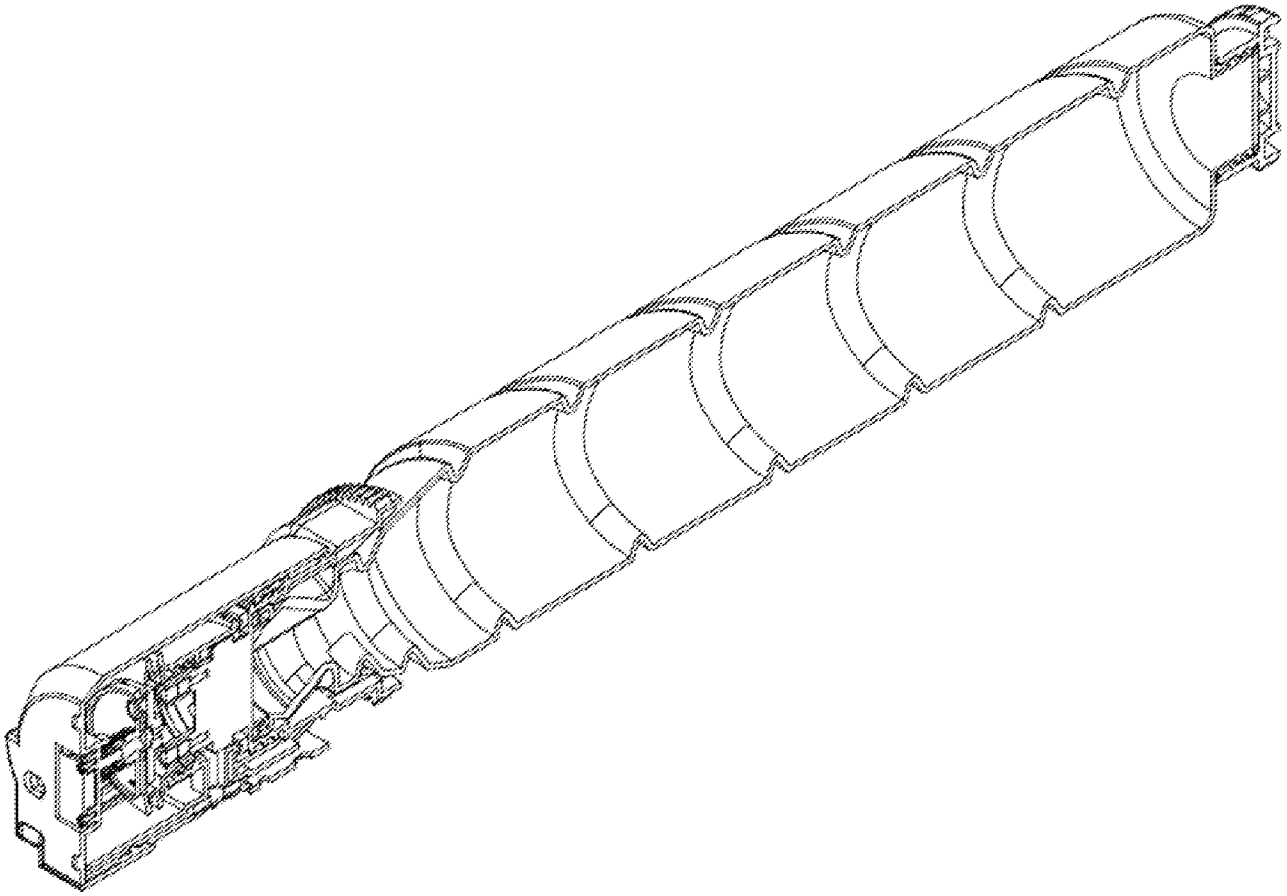
FIGS. 23A-23D schematically show the toner supply container when the first magnetic member and the second magnetic member are not aligned, where
Figure 23B:
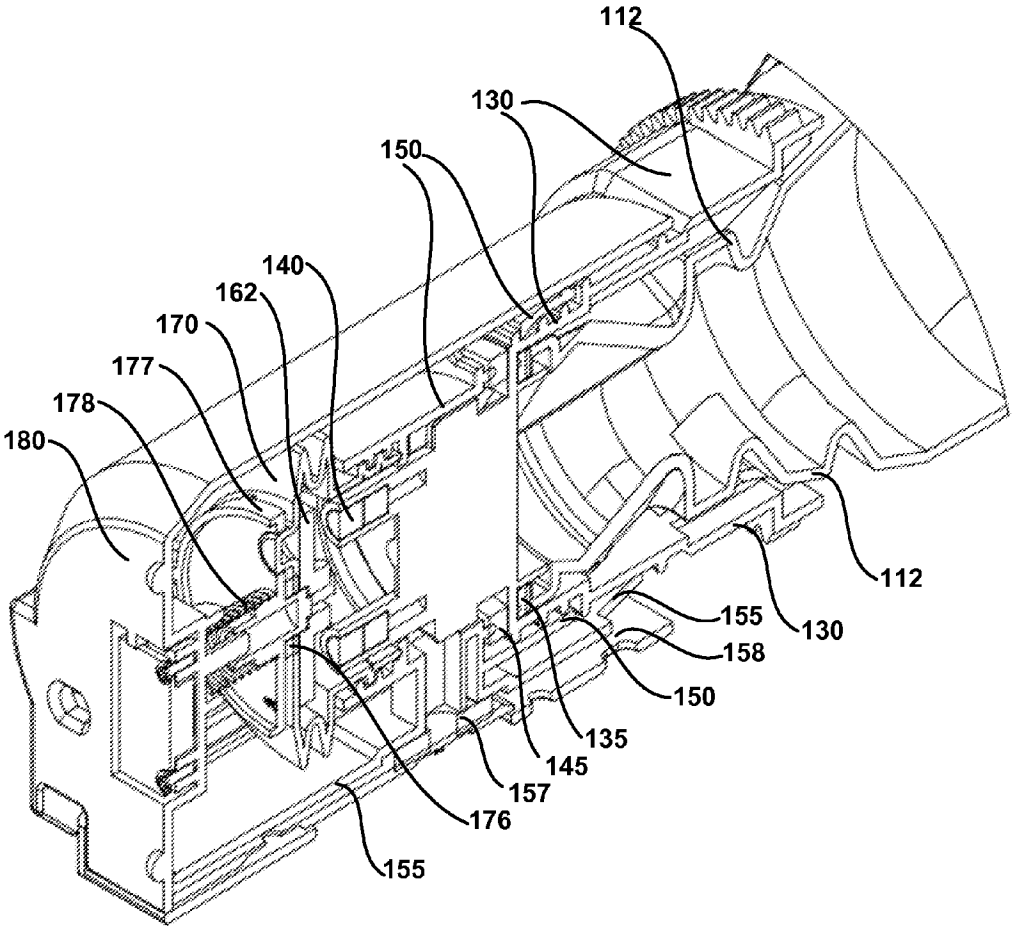
Figure 23C:
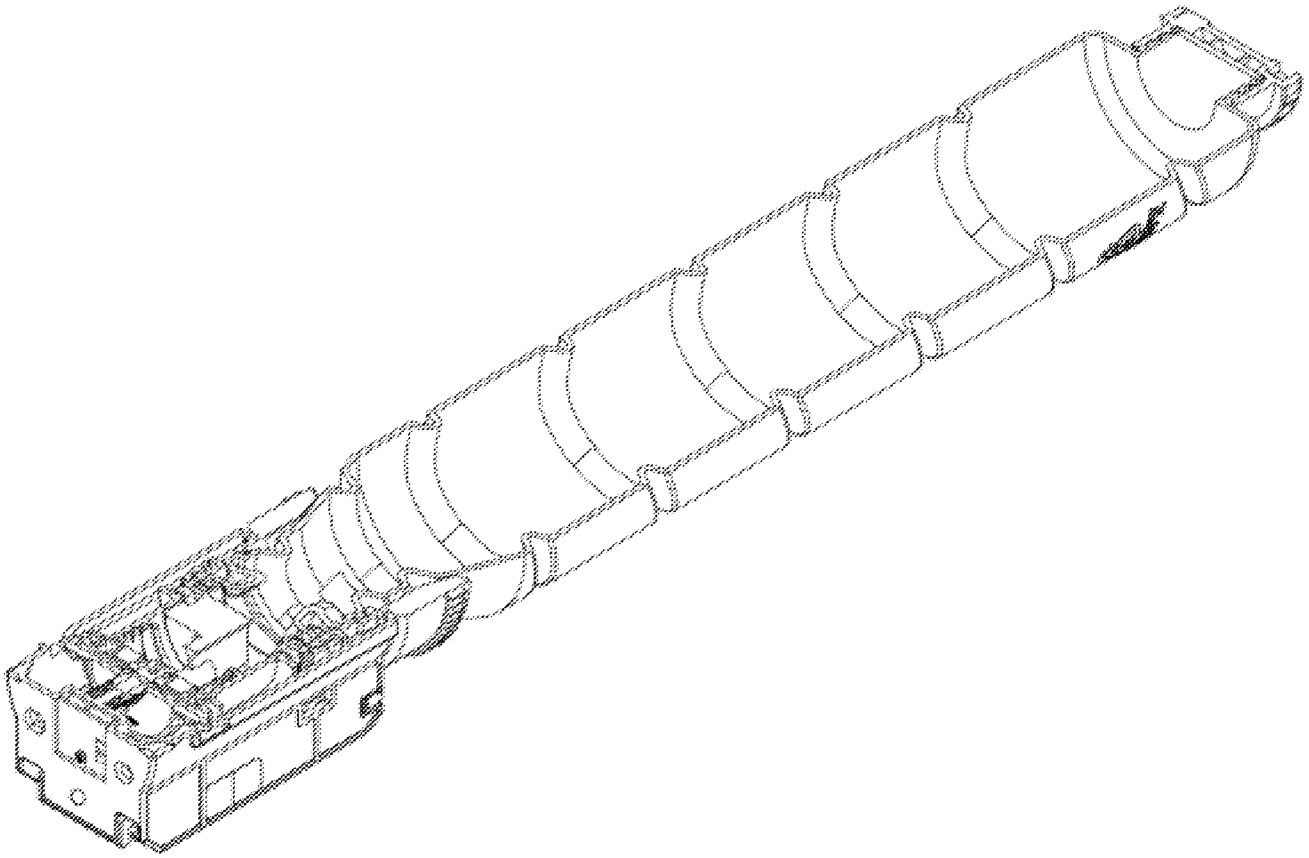
Figure 23D:
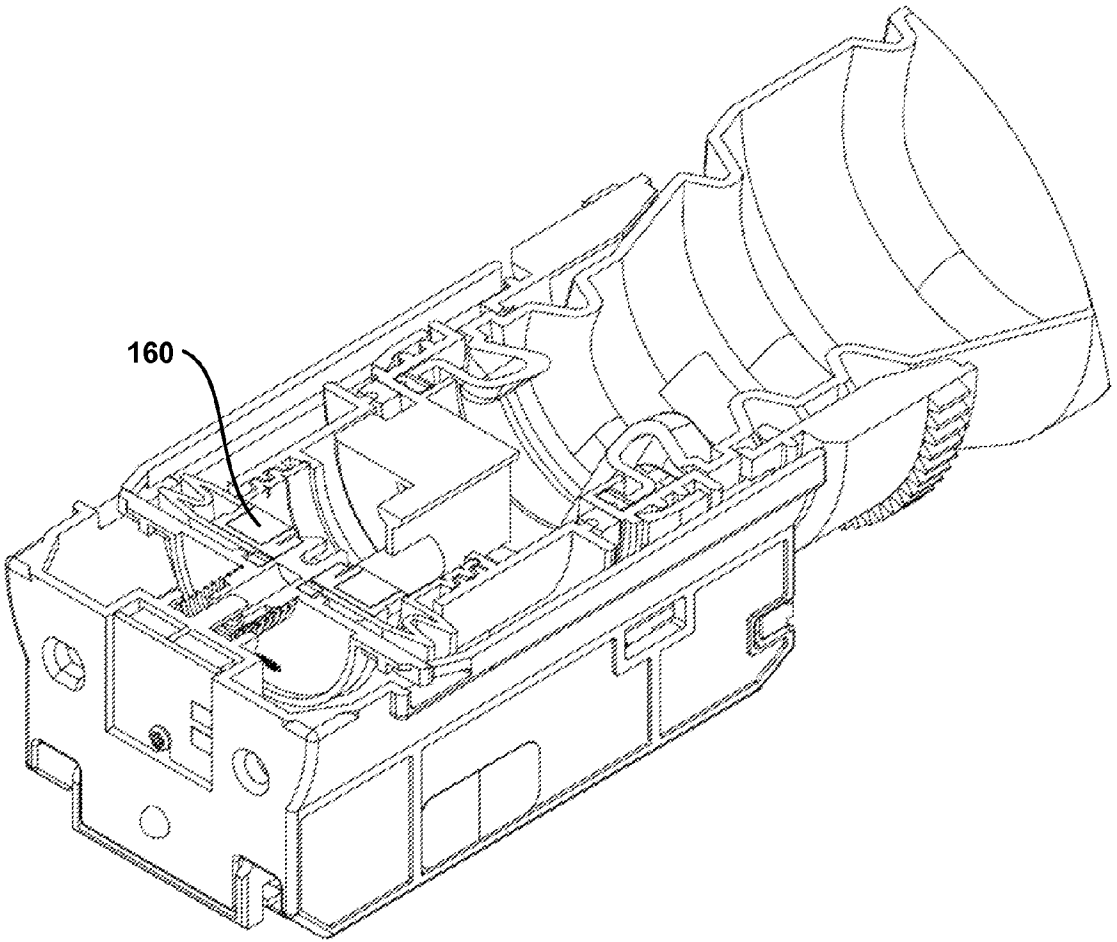

FIGS. 23A-23D schematically show the toner supply container 100 when the first magnetic member 140 and the second magnetic member 160 are not aligned, where FIG. 23A is a three dimensional sectional view with the toner supply container 100 cut in half from top to bottom, FIG. 23B is a partial enlarged view of FIG. 23A, FIG. 23C is a three dimensional sectional view with the toner supply container 100 cut in half from left to right, and FIG. 23D is a partial enlarged view of FIG. 23C.

As shown in FIG. 23B, the first magnetic member 140 is substantially disposed along the sectional surface when the toner supply container 100 is cut in half from top to bottom. As shown in FIG. 23D, the second magnetic member 160 is substantially disposed along the sectional surface when the toner supply container 100 is cut in half from left to right. When viewing from the D1/D2 direction, a line linking the magnetic bars 141 of the first magnetic member 140 located symmetrically at two sides and a line linking the magnetic bars 161 of the second magnetic member 160 located symmetrically at two sides are perpendicular to each other. Accordingly, the first magnetic member 140 and the second magnetic member 160 are away from each other and have weak interacting force toward each other. Under this situation, the elastic member 178 pushes the second fixing member 177 toward the D2 direction, and the second fixing member 177 pushes the pump 170 toward the D2 direction. Specifically, the second fixing member 177 pushes the first end 172 of the pump 170. Since the second end 174 of the pump 170 is fixed to the releasing member 150, the pumping portions 171 at the first end 172 of the pump 170 is compressed, and the space at the right side of the pump 170 is made smaller.

Figure 24A:
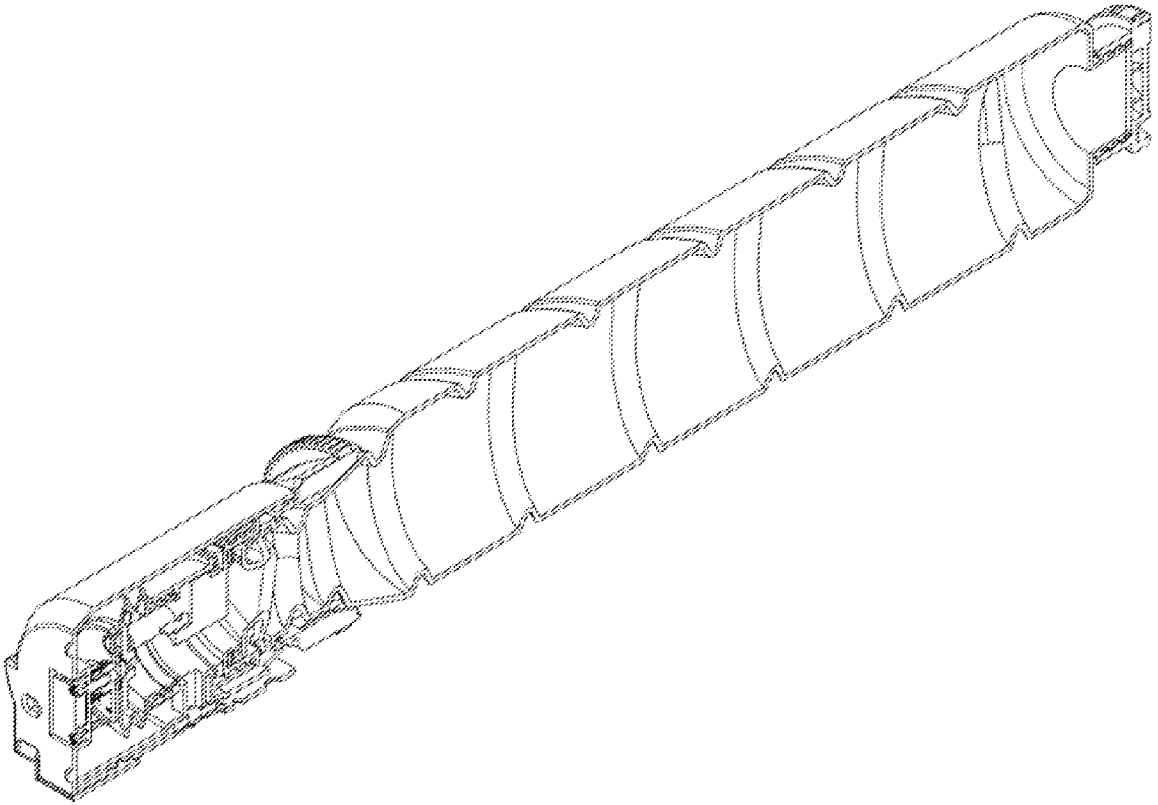
FIGS. 24A-24D schematically show the toner supply container when the first magnetic member and the second magnetic member are aligned, where
Figure 24B:
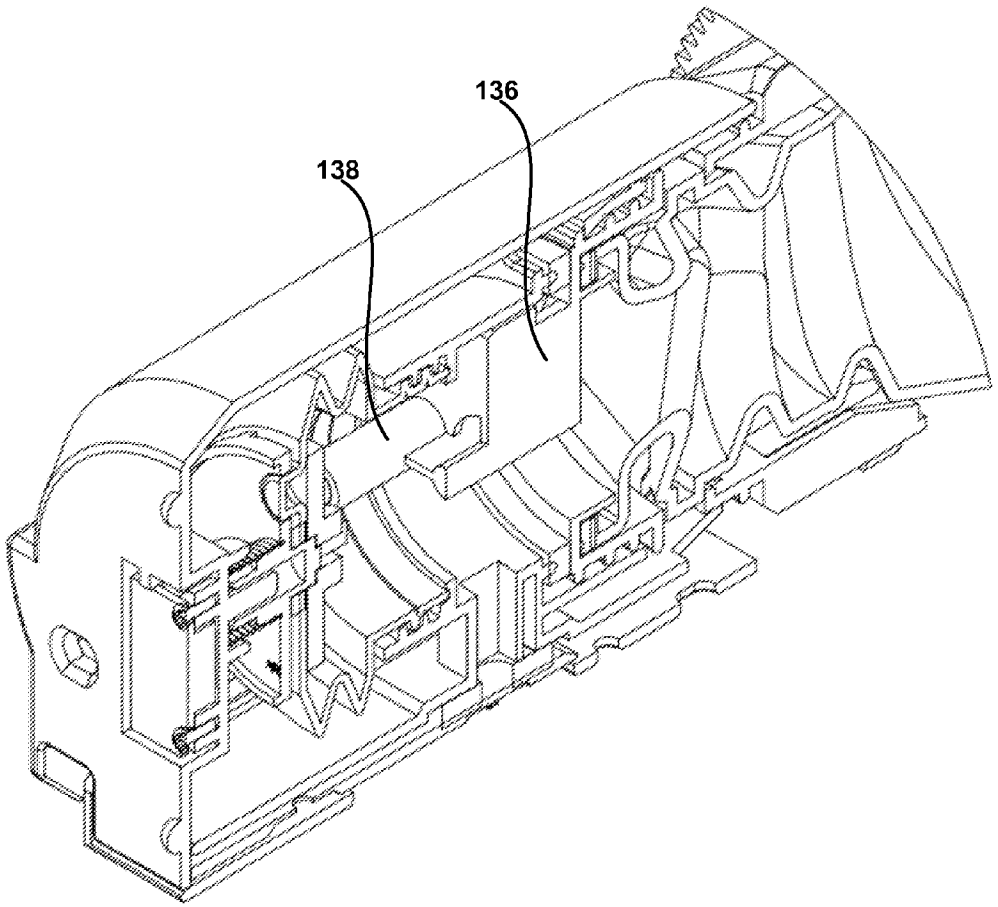
Figure 24C:
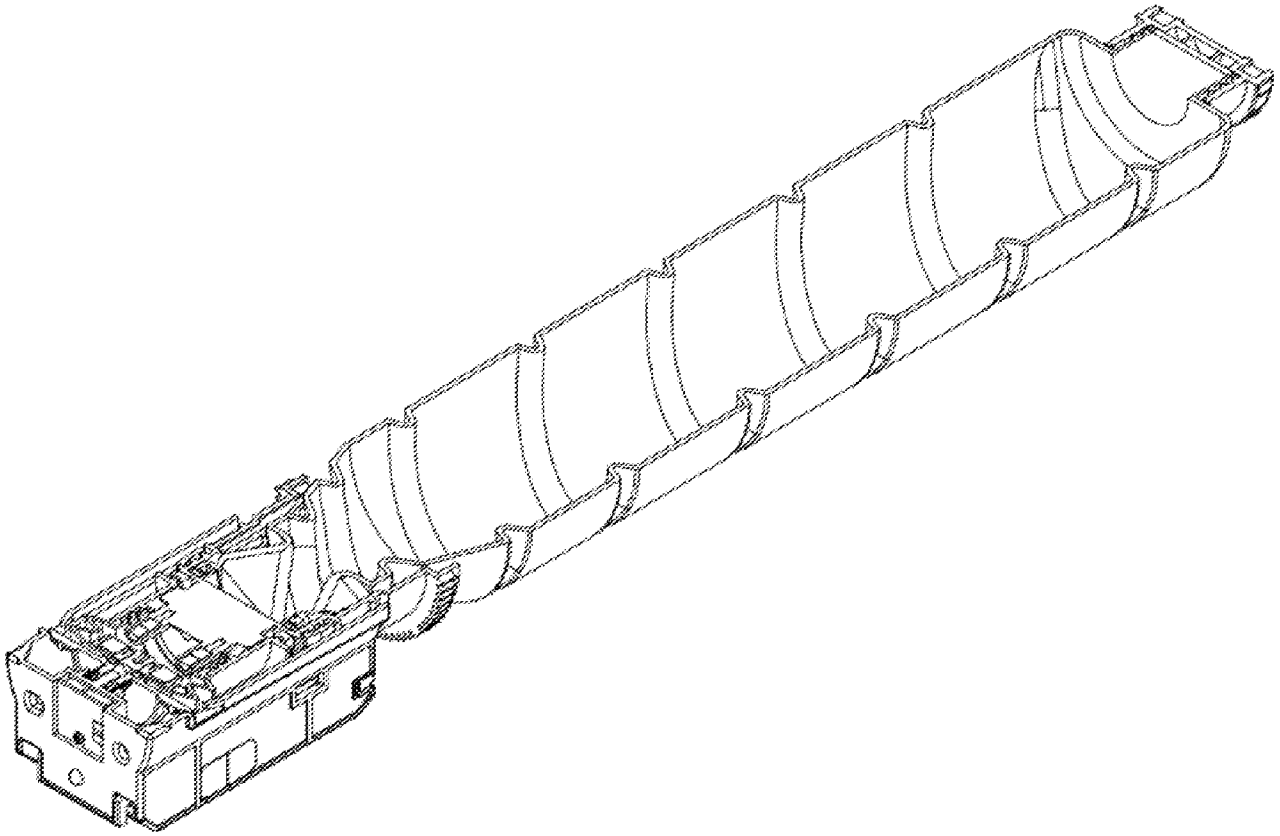
Figure 24D:
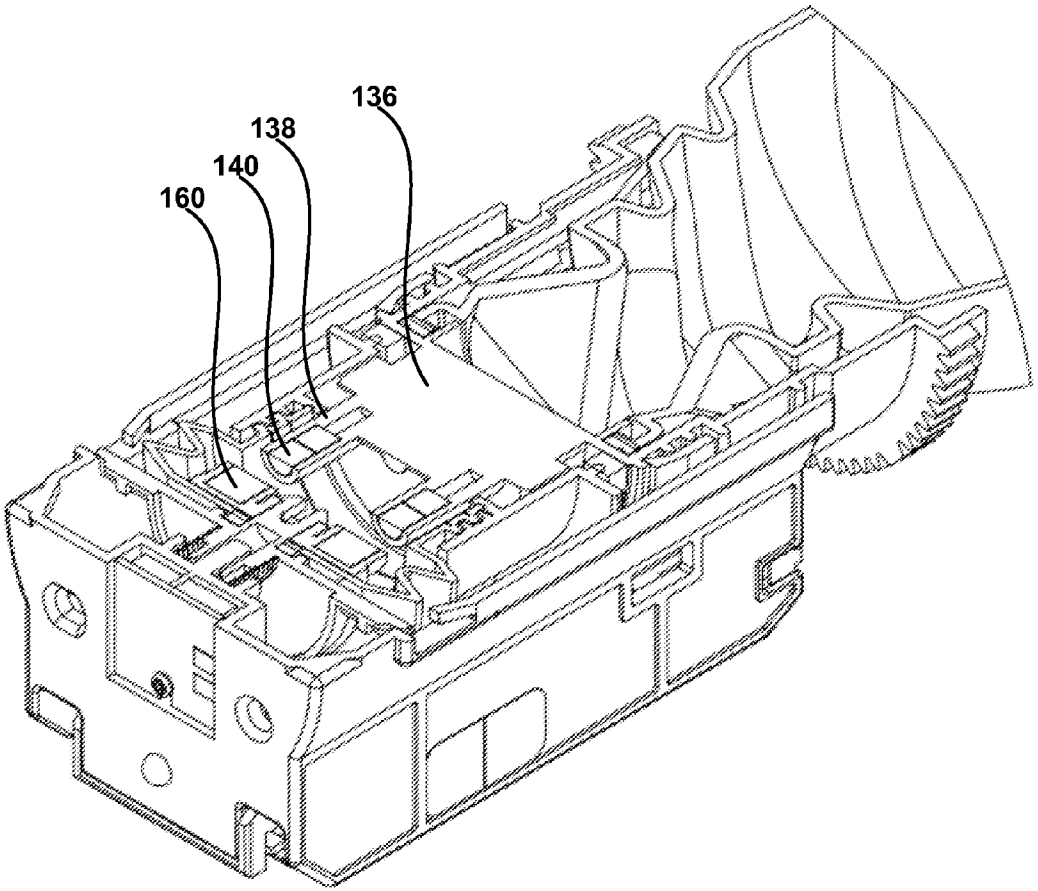

FIGS. 24A-24D schematically show the toner supply container 100 when the first magnetic member 140 and the second magnetic member 160 are aligned, where FIG. 24A is a three dimensional sectional view with the toner supply container 100 cut in half from top to bottom, FIG. 24B is a partial enlarged view of FIG. 24A, FIG. 24C is a three dimensional sectional view with the toner supply container 100 cut in half from left to right, and FIG. 24D is a partial enlarged view of FIG. 24C.

As shown in FIG. 23D, the first magnetic member 140 and the second magnetic member 160 are substantially disposed along the sectional surface when the toner supply container 100 is cut in half from left to right, and the first magnetic member 140 and the second magnetic member 160 are aligned with each other. Each of the magnetic bars 141 of the first magnetic member 140 forms a straight line with the corresponding second magnetic bar of the second magnetic member 160. The straight line is parallel to the rotational axis of the container body 110. When viewing from the D1/D2 direction, the line linking the magnetic bars 141 of the first magnetic member 140 and the line linking the magnetic bars 161 of the second magnetic member 160 overlaps with each other. The first magnetic member 140 and the second magnetic member 160 are configured to have the same polarity. For example, the magnetic bars 141 of the first magnetic member 140 has S and N poles, and the S pole of each magnetic bars 141 is located at the end away from the gear 130, and facing the D1 direction. The magnetic bars 161 of the second magnetic member 160 has S and N poles, and the S pole of each magnetic bars 161 is located at the end away from the pump 170, and facing the D2 direction. In other examples, the S and N may be switched. When the first magnetic member 140 and the second magnetic member 160 are aligned, the S pole of each first magnetic bar 141 is close the S pole of the corresponding magnetic bar 161. Therefore, a strong repulsive force exists between the first magnetic member 140 and the second magnetic member 160. In one embodiment, the repulsive force between the first magnetic member 140 and the second magnetic member 160 is the largest when they aligned perfectly as shown in FIG. 24D. Under this situation, the strong repulsive force pushes the second magnetic member 160 toward the D1 direction, the first fixing member 162 pushed the inner side surface of the pump 170, and the pumping portions 171 thus are expanded toward D1 direction. The pump 170 pushes the second fixing member 177 toward the D1 direction, and the second fixing member 177 compress the elastic member 178. During the push operation, the elastic force of the elastic member 178 toward the second fixing member 177 increases, the elastic force of the pump 170 toward the D2 direction increases, and the repulsive force between the first magnetic member 140 and the second magnetic member 160 decreases. The expansion of the pump 170 stops when the elastic force of the elastic member 178 and the pump 170 equal to the repulsive force between the first magnetic member 140 and the second magnetic member 160.

When the apparatus does not have sufficient toner for printing, the driving force from the apparatus is activated. In other embodiments, the driving force may be active at a predetermined time. The activated driving force drives the gear member 130 to rotate. The container 110 rotates together with the gear member 130, and pushes the toner within the container body 110 toward the D1 direction. A space from the container body 110 to the inner side surface of the first end 172 of the pump 170 is in fluid communication. Thus, the toner is movable within this space.

The rotating of the gear member 130 makes the first magnetic member 140 to rotate as well, such that the first magnetic member 140 moves relative to the static second magnetic member 160. The first magnetic member 140 and the second magnetic member 160 thus switches from un-aligned position to aligned position, and from the aligned position to the un-aligned position. In certain embodiments, the rotation of the first magnetic member 140 is a continuous operation, the movement of the first magnetic member 140 relative to the second magnetic member 160 is a continuous action, and the repulsive force between the first magnetic member 140 and the second magnetic member 160 changes continuously from the un-aligned position to the aligned position, and from the aligned position to the un-aligned position.

By the rotation of the first magnetic member 140 relative to the second magnetic member 160, the pump 170 is expanded, compressed, and expanded again. Therefore, a reciprocal expanding/compressing operation of the pump 170 is achieved.

The opening 156 is located at the bottom of the releasing member 150, and is in fluid communication with the space described above. The toner is releasable from the opening 156 toward the apparatus. The reciprocal operation of the pump 170 not only create a pressure difference during the reciprocal operation to push the toner through the opening 156 outward, but also can disperse the toner around the opening 156, to aid the feeding of the toner to the apparatus through the opening 156.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims as well as the invention including drawings.

Some references, which may include patents, patent applications, and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

What is claimed is:

1. A toner supply container for supply toner to an apparatus, comprising:

a container body having a first end and an opposite, second end defining an inner space therebetween for accommodating the toner;

a releasing mechanism, comprising:

a gear having a first end and an opposite, second end that is fixed to the first end of the container body;

a first magnetic member fixed to the gear;

a releasing member having a first end and an opposite, second end, an opening in fluid communication with the inner space of the container body, and a sliding sheet slidable to cover or to expose the opening, wherein the first end of the gear is rotatably fixed to the second end of the releasing member;

a pump movably connected to the first end of the releasing member;

a second magnetic member fixed to the pump;

an elastic member urging against the pump;

a housing configured to accommodate a part of the gear, the first magnetic member, the releasing member, the second magnetic member, the pump, and the elastic member; and a first fixing member for fixing the second magnetic member, and a second fixing member for fixing the elastic member, wherein the pump has a first end in a plate shape, the first fixing member is disposed at one side of the first end of the pump, the second fixing member is disposed at the other side of the first end, and a protrusion hook of the second fixing member passes through a through hole of the pump and a through hole of the first fixing member, and fixes the first fixing member, the pump and the second fixing member together, wherein when a driving force from the apparatus drives the gear to rotate, the rotation of the gear causes the first magnetic member to rotate so that the first magnetic member is alternatively aligned and misaligned with the second magnetic member, when the first magnetic member and the second magnetic member are aligned at an aligned position, the pump is pushed away from the releasing member by a repelling force generated between the first magnetic member and the second magnetic member, or pulled toward the releasing member by an attracting force generated between the first magnetic member and the second magnetic member, and when the first magnetic member and the second magnetic member are misaligned at a misaligned position, the pump is pushed toward the releasing member by the elastic member, or pulled away from the releasing member by the elastic member.

2. The toner supply container of claim 1, wherein when the first magnetic member rotates from the aligned position to the misaligned position relative to the second magnetic member, the pump pushes the toner located at the releasing member out to the apparatus through the opening.

3. The toner supply container of claim 1, wherein when the first magnetic member rotates from the misaligned position to the aligned position relative to the second magnetic member, the toner located at the container body is moved to the releasing member.

4. The toner supply container of claim 1, wherein when the toner supply container is detachably mounted to the apparatus, the sliding sheet is fixed to the apparatus, and the sliding sheet slides to expose the opening.

5. The toner supply container of claim 1, wherein the pump further has a second end opposite to the first end, the second end is fixed to the releasing member, such that the first fixing member, the pump and the second fixing member are fixed to the releasing member.

6. The toner supply container of claim 5, wherein the second fixing member further comprises a protrusion tube projected away from the pump, and engaging with a protrusion from the housing, the elastic member sleeves on the protrusion tube of the second fixing member and the protrusion of the housing, one end of the elastic member urges the second fixing member, and the other end of the elastic member urges the housing.

7. The toner supply container of claim 1, wherein the pump has a first end away from the releasing member and an opposite, second end facing the releasing member and fixed to the releasing member, and a plurality of pumping portions located at the first end, the pumping portions are movable relative to the releasing member.

8. The toner supply container of claim 1, wherein the container body, the gear, the releasing member, and the pump are in fluid communication.

9. The toner supply container of claim 1, wherein the first magnetic member comprises two pairs of magnetic bars that are symmetrically disposed relative to a longitudinal axis of the container body.

10. The toner supply container of claim 1, wherein the second magnetic member comprises two magnetic bars that are symmetrically disposed relative to a longitudinal axis of the container body.

11. A releasing mechanism usable for a toner supply container, comprising:

a rotatable structure having a first magnetic member;

a stationary structure engaged with the rotatable structure, and having an opening for releasing toner;

a pump movably connected to the stationary structure, and having at least one pumping portion that is expandable;

a second magnetic member connected to the at least one pumping portion; and a housing configured to accommodate a part of the rotatable structure, the first magnetic member, the stationary structure, the second magnetic member, and the pump, wherein the housing is fixed to the stationary structure, and the rotatable structure is rotatable relative to the housing, wherein when driving by a first force, the rotatable structure rotates relative to the stationary structure, such that the first magnetic member is alternatively aligned and misaligned with the second magnetic member, when the first magnetic member and the second magnetic member are aligned, the pump is pushed away from the stationary structure by a repelling force generated between the first magnetic member and the second magnetic member, or pulled toward the stationary structure by an attracting force generated between the first magnetic member and the second magnetic member, and when the first magnetic member and the second magnetic member are misaligned, the pump is pushed by a second force toward the stationary structure, or pulled by the second force away from the stationary structure; and wherein the second force is provided by an elastic member, one end of the elastic member urges the pump, and the other end of the elastic member urges the housing.

12. The releasing mechanism of claim 11, wherein when the first magnetic member and the second magnetic member are misaligned, the pump is pushed by the second force toward the stationary structure, and the toner is pushed out from the opening of the stationary structure.

13. The releasing mechanism of claim 11, wherein an inner space of the container body, an inner space of the rotatable structure, and an inner space of the stationary structure are in fluid communication.

14. The releasing mechanism of claim 11, further comprising a sliding sheet slidably attached to the stationary structure, wherein when the releasing mechanism is attached to an apparatus, the sliding sheet slides relative to the stationary structure to expose the opening, and the sliding sheet is fixed to the apparatus to positioning the stationary structure to the apparatus.

15. The releasing mechanism of claim 11, wherein the first magnetic member comprises two pairs of magnetic bars that are symmetrically disposed relative to an longitudinal axis of the rotatable structure.

16. The releasing mechanism of claim 11, wherein the second magnetic member comprises two magnetic bars that are symmetrically disposed relative to an longitudinal axis of the stationary structure.

17. An apparatus for electrophotographic image forming, comprising:

a toner supply container having the releasing mechanism of claim 11.

18. A releasing mechanism usable for a toner supply container, comprising:

a rotatable structure having a first magnetic member, wherein the first magnetic member comprises two pairs of magnetic bars that are symmetrically disposed relative to an longitudinal axis of the rotatable structure;

a stationary structure engaged with the rotatable structure, and having an opening for releasing toner;

a pump movably connected to the stationary structure, and having at least one pumping portion that is expandable; and a second magnetic member connected to the at least one pumping portion, wherein when driving by a first force, the rotatable structure rotates relative to the stationary structure, such that the first magnetic member is alternatively aligned and misaligned with the second magnetic member, when the first magnetic member and the second magnetic member are aligned, the pump is pushed away from the stationary structure by a repelling force generated between the first magnetic member and the second magnetic member, or pulled toward the stationary structure by an attracting force generated between the first magnetic member and the second magnetic member, and when the first magnetic member and the second magnetic member are misaligned, the pump is pushed by a second force toward the stationary structure, or pulled by the second force away from the stationary structure.

19. A releasing mechanism usable for a toner supply container, comprising:

a rotatable structure having a first magnetic member;

a stationary structure engaged with the rotatable structure, and having an opening for releasing toner;

a pump movably connected to the stationary structure, and having at least one pumping portion that is expandable; and a second magnetic member connected to the at least one pumping portion, wherein the second magnetic member comprises two magnetic bars that are symmetrically disposed relative to an longitudinal axis of the stationary structure, wherein when driving by a first force, the rotatable structure rotates relative to the stationary structure, such that the first magnetic member is alternatively aligned and misaligned with the second magnetic member, when the first magnetic member and the second magnetic member are aligned, the pump is pushed away from the stationary structure by a repelling force generated between the first magnetic member and the second magnetic member, or pulled toward the stationary structure by an attracting force generated between the first magnetic member and the second magnetic member, and when the first magnetic member and the second magnetic member are misaligned, the pump is pushed by a second force toward the stationary structure, or pulled by the second force away from the stationary structure.

* * * * *